US010657861B2

(12) United States Patent
Gao et al.

(10) Patent No.: US 10,657,861 B2
(45) Date of Patent: May 19, 2020

(54) DISPLAY PANEL AND ITS DRIVING METHOD AND DRIVING DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Bo Gao, Beijing (CN); Xiurong Wang, Beijing (CN); Hao Zhang, Beijing (CN); Lingyun Shi, Beijing (CN); Xue Dong, Beijing (CN); Yafei Li, Beijing (CN)

(73) Assignees: BOE TECHNOLOGY GROUP CO., LTD, Beijing (CN); BEIJING BOE OPTOELECTRONICS TECHNOLOGY CO., LTD, Beijing (CN)

( * ) Notice: Subject to any disclaimer, the term of this patent is extended or adjusted under 35 U.S.C. 154(b) by 267 days.

(21) Appl. No.: 15/115,145

(22) PCT Filed: Jan. 29, 2016

(86) PCT No.: PCT/CN2016/072820
§ 371 (c)(1),
(2) Date: Jul. 28, 2016

(87) PCT Pub. No.: WO2017/012332
PCT Pub. Date: Jan. 26, 2017

(65) Prior Publication Data

US 2017/0148420 A1 May 25, 2017

(30) Foreign Application Priority Data

Jul. 21, 2015 (CN) ..... 2015 1 0432508

(51) Int. Cl.
*G09G 3/20* (2006.01)

(52) U.S. Cl.
CPC ..... *G09G 3/20* (2013.01); *G09G 2300/0408* (2013.01); *G09G 2300/08* (2013.01);
(Continued)

(58) Field of Classification Search
CPC ..... G09G 5/391
See application file for complete search history.

(56) References Cited

U.S. PATENT DOCUMENTS 7,038,651 B2 5/2006 Nitta et al.
7,079,106 B2 7/2006 Matsuda et al.
(Continued)

FOREIGN PATENT DOCUMENTS

CN 1455382 A 11/2003
CN 1460982 A 12/2003
(Continued)

OTHER PUBLICATIONS

Dictionary.com, "adjacent," in Dictionary.com Unabridged. Source location: Random House, Inc. http://dictionary.reference.com/browse/adjacent, Nov. 18, 2011, p. 1.*
(Continued)

*Primary Examiner* — Patrick F Marinelli
(74) *Attorney, Agent, or Firm* — Collard & Roe, P.C.

(57) ABSTRACT

A display panel and its driving method and driving device are provided for selectively reducing display resolution of a display panel, thereby decreasing display power consumption. The display panel comprises: gate lines (11) and data lines (12) disposed across to each other; at least one switching unit (13) connected between different gate lines (11), configured to control whether at least two rows of gate lines (11) are conducted; and a driving control module (14) having first output terminals (141) connected one by one to control terminals of the at least one switching unit (13) and second output terminals (142) connected one by one to input
(Continued)

terminals of the data lines (12); wherein the driving control module (14) outputs, via the first output terminals (141), a control signal for controlling whether a corresponding switching unit (13) is switched on, and decides, based on an on/off state of the switching unit (13), whether to output an image signal to a corresponding data line (12) via the second output terminals (142).

18 Claims, 6 Drawing Sheets

(52) U.S. Cl.
CPC ..... *G09G 2310/0205* (2013.01); *G09G 2310/0267* (2013.01); *G09G 2320/0613* (2013.01); *G09G 2320/103* (2013.01); *G09G 2330/021* (2013.01); *G09G 2340/0407* (2013.01); *G09G 2340/0435* (2013.01)

(56) References Cited

U.S. PATENT DOCUMENTS

| | | | | |
|---|---|---|---|---|
| 8,670,004 | B2 | 3/2014 | Vieri et al. | |
| 10,079,005 | B2 * | 9/2018 | Gao | G09G 5/391 |
| 2001/0052888 | A1 * | 12/2001 | Hebiguchi | G09G 3/3666 345/87 |
| 2002/0000970 | A1 * | 1/2002 | Akimoto | G09G 3/3648 345/100 |
| 2002/0060657 | A1 * | 5/2002 | Matsueda | G09G 3/2011 345/89 |
| 2007/0242014 | A1 * | 10/2007 | Lee | G02F 1/133514 345/88 |
| 2007/0273633 | A1 | 11/2007 | Hashimoto et al. | |
| 2008/0055519 | A1 * | 3/2008 | Battersby | G09G 3/3648 349/68 |
| 2008/0100601 | A1 * | 5/2008 | Moon | G09G 3/3648 345/204 |
| 2008/0143695 | A1 * | 6/2008 | Juenemann | G09G 3/3611 345/204 |
| 2008/0225189 | A1 * | 9/2008 | Yang | G09G 3/3659 349/37 |
| 2008/0239178 | A1 * | 10/2008 | Nagai | G02F 1/133555 349/33 |
| 2008/0284719 | A1 * | 11/2008 | Yoshida | G02F 1/136277 345/102 |
| 2016/0171938 | A1 * | 6/2016 | Na | G09G 3/3688 345/698 |
| 2016/0189677 | A1 | 6/2016 | Cao et al. | |
| 2016/0329014 | A1 * | 11/2016 | Lee | G09G 3/2096 |
| 2017/0148420 | A1 * | 5/2017 | Gao | G09G 5/391 |
| 2017/0193884 | A1 * | 7/2017 | He | G09G 3/20 |
| 2017/0193972 | A1 * | 7/2017 | Gao | G09G 5/391 |

FOREIGN PATENT DOCUMENTS

| | | | |
|---|---|---|---|
| CN | 1584713 | A | 2/2005 |
| CN | 1885395 | A | 12/2006 |
| CN | 101083064 | A | 12/2007 |
| CN | 101359143 | A | 2/2009 |
| CN | 102356422 | A | 2/2012 |
| CN | 203338718 | U | 12/2013 |
| CN | 104282269 | A | 1/2015 |
| CN | 104916250 | A | 9/2015 |
| CN | 104992686 | A | 10/2015 |
| JP | H08-320496 | A | 12/1996 |

OTHER PUBLICATIONS

Second Chinese Office Action in Chinese Application No. 201510432508.3, dated Sep. 7, 2017 with English translation.
International Search Report of PCT/CN2016/072820 in Chinese, dated Apr. 27, 2016 with English translation.
Notice of Transmittal of the International Search Report of PCT/CN2016/072820 in Chinese, dated Apr. 27, 2016.
Written Opinion of the International Searching Authority of PCT/CN2016/072820 in Chinese, dated Apr. 27, 2016 with English translation.
Chinese Office Action in Chinese Application No. 201510432508.3, dated Feb. 24, 2017 with English translation.

* cited by examiner

DISPLAY PANEL AND ITS DRIVING METHOD AND DRIVING DEVICE

CROSS REFERENCE TO RELATED APPLICATIONS

This application is the National Stage of PCT/CN2016/072820 filed on Jan. 29, 2016, which claims priority under 35 U.S.C. § 119 of Chinese Application No. 201510432508.3 filed on Jul. 21, 2015, the disclosure of which is incorporated by reference.

TECHNICAL FIELD

The present disclosure relates to a display panel and its driving method and driving device.

BACKGROUND

With the unceasing development of display technology, requirements on a display resolution of a display panel also become higher and higher. According to the display resolution, display panels can be divided into Ultra-High-Definition (UHD) display panels, Full-High-Definition (FHD) display panels, and High-Definition (HD) display panels. However, a majority of module products adopt an unchanged pixel structure, that is, the resolution cannot be changed. For example, if a display panel is an Ultra-High-Definition display panel, and a resolution of an image to be displayed is relatively low but still is within a range of Ultra-High-Definition display resolution, then when the image is displayed on the Ultra-High-Definition display panel, before displaying, it needs to increase the resolution of the image to a value which is the same with that of the display panel.

Therefore, in the module products, the resolution of the display panel cannot be changed. The display panel can only carry out Ultra-High-Definition (UHD) displaying, or Full-High-Definition (FHD) displaying, or High-Definition (HD) displaying. Thus, in some cases, for example, when displaying a video, the display panel is always in an Ultra-High-Definition display state, but cannot change the display resolution flexibly, increasing display power consumption of the display panel.

In a summary, the display panels known to the inventor cannot selectively reduce the display resolution of the display panel, and increase the display power consumption of the display panel.

SUMMARY

Embodiments of the present disclosure provide a display panel and its driving method and driving device, for selectively reducing the display resolution of the display panel, and decreasing display power consumption of the display panel.

A display panel according to an embodiment of the present disclosure comprises: gate lines and data lines disposed across to each other; at least one switching unit connected between different gate lines, and configured to control whether at least two rows of gate lines are conducted; and a driving control module having first output terminals connected one by one to control terminals of the at least one switching unit and second output terminals connected one by one to input terminals of the data lines; wherein the driving control module outputs, via the first output terminals, a control signal for controlling whether to switch on a corresponding switching unit, and decides, according to an on/off state of the switching unit, whether to output an image signal to a corresponding data line via the second output terminals.

In the display panel according to an embodiment of the present disclosure, at least one switching unit is provided between different gate lines to control whether at least two rows of gate lines are conducted; the switching unit is connected one by one to second output terminals of the driving control module to receive a control signal outputted by the driving control module for controlling whether to switch on the switching unit; the data lines in the display panel are connected one by one to the second output terminals of the driving control module to receive an image signal outputted by the driving control module. When the switching unit receives the control signal outputted by the driving control module via the first output terminals for controlling the switching unit to be switched on, the switching unit is switched on, so that two rows of gate lines connected to the switching unit perform scanning simultaneously, meanwhile, according to the switching on state of the switching unit, the driving control module outputs the image signal to the data lines to which the two rows of gate lines correspond, so that the display resolution of the display panel is reduced, and the display power consumption of the display panel is decreased.

Optionally, a switching unit is provided between each pair of two adjacent rows of gate lines.

By means of providing a switching unit between each pair of two adjacent rows of gate lines, and based on switching on of the switching unit, the display resolution of the display panel is reduced to a larger extent, and the display power consumption of the display panel is decreased.

Optionally, the switching unit is a thin film transistor. For each thin film transistor, a source and a drain of the thin film transistor are connected respectively to two rows of gate lines adjacent to the thin film transistor, and a gate of the thin film transistor is connected to second output terminals of the driving control module.

Optionally, the driving control module may be configured to:

determine, based on a resolution of an image to be displayed which is transmitted by a signal source, a display mode to which the resolution of the image to be displayed corresponds; and determine, based on the display mode, switching units that need to be switched on and switched off, output via the first output terminals a control signal for controlling whether to switch on a corresponding switching unit, and output via the second output terminals an image signal to a corresponding data line based on an on/off state of the switching unit.

Through the control performed by the driving control module over the switching unit and over the data lines, the display resolution of the display panel is reduced, and the display power consumption of the display panel is decreased. The driving control module determines, based on a resolution of an image to be displayed which is transmitted from a signal source, a display mode to which the resolution of the image to be displayed corresponds, and then determines, based on the display mode, switching units that need to be switched on and switched off, outputs a control signal to each switching unit, and outputs an image signal of the image to be displayed to a corresponding data line based on an on/off state of the switching unit.

Optionally, the driving control module is further configured to:

receive a voltage signal of an image to be displayed which is transmitted by a signal source;

determine current image display mode based on a voltage signal of an image to be displayed of two adjacent frames, the image display mode being a static display mode or a dynamic display mode;

in a case where the image display mode is a static display mode, based on a resolution of the image to be displayed, determine a switching unit that needs to be switched off, output, via the first output terminals, a control signal for controlling a corresponding switching unit is to be switched on or switched off, and output; via the second output terminals, an image signal to a corresponding data line based on an on/off state of the switching unit.

The driving control module in the display panel according to the embodiment of the present disclosure can further receive a voltage signal of an image to be displayed which is transmitted by a signal source; and determine an image display mode of the image to be displayed based on the voltage signal, so that when the image display mode is determined as a static display mode, based on a resolution of the image to be displayed, the driving control module determines the switching unit that needs to be switched off; and outputs a control signal for controlling a corresponding switching unit to be switched off to the corresponding switching unit, and meanwhile outputs an image signal to a corresponding data line, so that when the image display mode of the image to be displayed is the static display mode, through switching off the switching unit, the display resolution in the display panel changes from low to high, accordingly, the resolution of the image to be displayed during static displaying is increased, user experience is improved.

Optionally, the driving control module is further configured to:

in a case where the image display mode is a dynamic display mode, increase a frame frequency for image transmission.

When the driving control module determines that the image display mode is a dynamic display mode, a frame frequency for image transmission is increased, so that fluency when the display panel displays a dynamic image such as video is improved, and in switch user experience is improved.

A driving method for the display panel according to an embodiment of the present application comprises:

determining a resolution of an image to be displayed which is transmitted by a signal source;

determining a display mode to which the resolution of the image to be displayed corresponds; and based on the display mode, determining switching units that need to be switched on and switched off, and controlling each switching unit to be switched on or switched off and controlling whether each data line outputs an image data.

In the driving method for the display panel according to the embodiment of the present disclosure, first, a resolution of an image to be displayed which is transmitted from a signal source is received, then, a display mode to which the resolution of the image to be displayed corresponds is determined, finally, based on the display mode, switching units that need to be switched on and switched off are determined, a control signal for switching on or switching off a corresponding switching unit is transmitted to the corresponding switching unit, and an image signal of the image to be displayed is transmitted to the corresponding data line according to the switching on state of the switching unit. Through switching on the switching unit, two rows of gate lines connected to the switching unit perform scanning simultaneously, the data lines to which the two rows of gate lines correspond receive the image signal, so that the display resolution of the display panel is reduced, and the display power consumption of the display panel is decreased.

Optionally, the display mode is an ultra-high-definition display mode, a full-high-definition display mode, or a high-definition display mode.

Optionally, in a case where the resolution of the image to be displayed is greater than or equal to a maximum resolution of the display panel, it is determined that the display mode to which the resolution of the image to be displayed corresponds is the ultra-high-definition display mode; in a case where the resolution of the image to be displayed is less than the maximum resolution of the display panel and greater than or equal to a half of the maximum resolution of the display panel, it is determined that the display mode to which the resolution of the image to be displayed corresponds is the full-high-definition display mode; in a case where the resolution of the image to be displayed is less than a half of the maximum resolution of the display panel and greater than or equal to one third of the maximum resolution of the display panel, it is determined that the display mode to which the resolution of the image to be displayed corresponds is the high-definition display mode.

Optionally, after it is determined that the display mode to which the resolution of the image to be displayed corresponds is the ultra-high-definition display mode, the method further comprises:

in a case where a user instruction message is received to change the display mode into the full-high-definition display mode, determining that the display mode to which the resolution of the image to be displayed corresponds is the full-high-definition display mode;

in a case where a user instruction message is received to change the display mode into the high-definition display mode, determining that the display mode to which the resolution of the image to be displayed corresponds is the high-definition display mode.

Optionally, after it is determined that the display mode to which the resolution of the image to be displayed corresponds is the full-high-definition display mode, the method further comprises:

in a case where a user instruction message is received to change the display mode into the high-definition display mode, determining that the display mode to which the resolution of the image to be displayed corresponds is the high-definition display mode.

Optionally, in a case where the display mode is the ultra-high-definition display mode, each switching unit is controlled to be switched off, and an image signal of the image to be displayed is transmitted to each data line; in a case where the display mode is the full-high-definition display mode, switching units in odd-numbered rows are controlled to be switched on and switching units in even-numbered rows are controlled to be switched off, and an image signal of the image to be displayed is transmitted to data lines in odd-numbered rows, or, switching units in odd-numbered rows are controlled to be switched off and switching units in even-numbered rows are controlled to be switched on, and an image signal of the image to be displayed is transmitted to data lines in even-numbered rows; in a case where the display mode is the high-definition display mode, first and second switching units within each group of switching units are controlled to be switched on and a third switching unit within each group of switching units is controlled to be switched off, and an image signal of the image to be displayed is transmitted to first, fifth, and ninth data lines within each group of data lines, each group of switching units including three adjacent switching units in each column, each group of data lines including every nine adjacent data lines.

When the display mode of the image to be displayed is the ultra-high-definition display mode, the display mode of the image may be reduced to the full-high-definition display mode or the high-definition display mode as needed, and the display resolution of the display panel is reduced through switching on the switching unit, so that the display resolution of the image to be displayed in the display panel is reduced, meanwhile, the display power consumption of the display panel is decreased; when the display mode of the image to be displayed is the full-high-definition display mode, the display mode of said image may be reduced to the high-definition display mode, and the display resolution of the display panel is reduced through switching on the switching unit, so that the display resolution of the image to be displayed in the display panel is reduced, meanwhile, the display power consumption of the display panel is decreased.

Optionally, in a case where the switching units are N-type thin film transistors, a signal controlling the switching units to be switched on is a high level, a signal controlling the switching units to be switched off is a low level; in a case where the switching units are P-type thin film transistors, a signal controlling the switching units to be switched on is a low level, a signal controlling the switching units to be switched off is a high level.

Optionally, the method further comprises:

receiving a voltage signal of an image to be displayed which is transmitted by a signal source;

determining current image display mode based on a voltage signal of an image to be displayed of two adjacent frames; the image display mode being a static display mode or a dynamic display mode; and in a case where the image display mode is a static display mode, based on a resolution of the image to be displayed, determining a switching unit that needs to be switched off and controlling each switching unit to be switched on or off, and outputting an image signal to a corresponding data line based on an on/off state of the switching unit.

The driving method for the display panel according to the embodiment of the present disclosure can further determine the image display mode of the image to be displayed through the voltage signal of the image to be displayed, so that when it is determined that the image display mode of the image to be displayed is the static display mode, the switching unit that needs to be switched off is determined based on the resolution of the image, a control signal for controlling the switching off of the switching unit is transmitted to the corresponding switching unit, meanwhile, the image signal is transmitted to the corresponding data signal according to the state of the switching unit, so that when the image display mode of the image to be displayed is the static display mode; through the switching off of the switching unit, the display resolution of the display panel changes from low to high, to increase the resolution of the image to be displayed during static displaying, thereby user experience is improved.

Optionally, the driving method further comprises:

in a case where the image display mode is a dynamic display mode, increasing a frame frequency for image transmission.

The driving method further comprises, when the image display mode of the image to be displayed is a dynamic display mode, increasing a frame frequency for image transmission so that fluency when the display panel displays a dynamic image such as video is improved. Thus, by means of automatically determining the image display mode of the image to be displayed, automatically decreasing the resolution of the image to be displayed or automatically increasing the resolution of the image to be displayed, based on the image display mode of the to be-displayed image, resolution of the image in the static display mode is increased, or fluency of the image in the dynamic display mode is improved, so that user experience is improved.

Optionally, in a case where the voltage signal of the image to be displayed is the same with a voltage signal of an image displayed in a previous frame, the current image display mode is determined to be a static display mode; in a case where the voltage signal of the image to be displayed is different from a voltage signal of an image displayed in a previous frame, the current image display mode is determined to be a dynamic display mode.

Optionally, in a case where the image display mode is the static display mode, and the resolution of the image to be displayed is less than the maximum resolution of the display panel and greater than or equal to a half of the maximum resolution of the display panel; each switching unit is controlled to be switched off, and an image signal of the image to be displayed is transmitted to each data line; in a case where the display mode is the static image display mode, and the resolution of the image to be displayed is less than a half of the maximum resolution of the display panel and greater than or equal to one third of the maximum resolution of the display panel; each switching unit is controlled to be switched off; and an image signal of the image to be displayed is transmitted to each data line, or switching units in odd-numbered rows are controlled to be switched on and switching units in even-numbered rows are controlled to be switched off, and an image signal of the image to be displayed is transmitted to data lines in odd-numbered rows, or switching units in odd-numbered rows are controlled to be switched off and switching units in even-numbered rows are controlled to be switched on, and an image signal of the image to be displayed is transmitted to data lines in even-numbered rows.

A driving method for the display panel according to another embodiment of the present disclosure comprises:

receiving a voltage signal of an image to be displayed which is transmitted by a signal source;

determining current image display mode based on a voltage signal of an image to be displayed of two adjacent frames; the image display mode being a static display mode or a dynamic display mode; and in a case where the image display mode is a static display mode, based on a resolution of the image to be displayed, determining a switching unit that needs to be switched off, controlling each switching unit to be switched on or switched off, and outputting an image signal to a corresponding data line based on an on/off state of the switching unit.

The driving method for the display panel according to another embodiment of the present disclosure determines the image display mode of the image to be displayed through the voltage signal of the image to be displayed, thereby determines the switching unit that needs to be switched off based on the resolution of said image when it is determined that the display mode of the image to be displayed is the static image mode, transmits the control signal for controlling to switch off the switching unit to the corresponding switching unit, meanwhile transmits the image signal to the corresponding data line based on the state of the switching unit, so that when the display mode of the image to be displayed is the static image mode, through the switching off of the switching unit, the display resolution in the display panel changes from low to high, accordingly, the resolution of the image to be displayed during static displaying is increased, user experience is improved.

Optionally, the driving method further comprises:

in a case where the image display mode is a dynamic display mode, increasing a frame frequency for image transmission.

When it is determined that the image display mode of the image to be displayed is a dynamic display mode; a frame frequency for image transmission is increased, thereby fluency when the display panel displays a dynamic image such as video is improved. Thus, by means of automatically determining the image display mode of the image to be displayed, automatically decreasing the resolution of the image to be displayed or automatically increasing the resolution of the image to be displayed, based on the image display mode of the to be-displayed image, resolution of the image in the static display mode is increased, or fluency of the image in the dynamic display mode is improved, so that user experience is improved.

Optionally, in a case where the voltage signal of the image to be displayed is the same with a voltage signal of an image displayed in a previous frame, it is determined that the current image display mode is the static display mode; in a case where the voltage signal of the image to be displayed is different from a voltage signal of an image displayed in a previous frame, it is determined that the current image display mode is the dynamic display mode.

Optionally, in a case where the image display mode is the static display mode, and the resolution of the image to be displayed is less than the maximum resolution of the display panel and greater than or equal to a half of the maximum resolution of the display panel, each switching unit is controlled to be switched off, and an image signal of the image to be displayed is transmitted to each data line.

In a case where the display mode is the static image display mode; and the resolution of the image to be displayed is less than a half of the maximum resolution of the display panel and greater than or equal to one third of the maximum resolution of the display panel; each switching unit is controlled to be switched off, and an image signal of the image to be displayed is transmitted to each data line; or, switching units in odd-numbered rows are controlled to be switched on and switching units in even-numbered rows are controlled to be switched off, and an image signal of the image to be displayed is transmitted to data lines in odd-numbered rows; or, switching units in odd-numbered rows are controlled to be switched off and switching units in even-numbered rows are controlled to be switched on, and an image signal of the image to be displayed is transmitted to data lines in even-numbered rows.

A driving device for the display panel according to the embodiment of the present disclosure comprises:

a first determining unit configured to determine a resolution of an image to be displayed which is transmitted by a signal source;

a second determining unit configured to determine a display mode to which the resolution of the image to be displayed corresponds; and a first control unit configured to, based on the display mode, determine switching units that need to be switched on and switched off, and control each switching unit to be switched on or switched off and control whether each data line outputs an image data.

In the driving device for the display panel according to the embodiment of the present disclosure, first, a resolution of an image to be displayed which is transmitted from a signal source is received, then, a display mode to which the resolution of the image to be displayed corresponds is determined, finally, based on the display mode, switching units that need to be switched on and switched off are determined, a control signal for switching on or switching off a corresponding switching unit is transmitted to the corresponding switching unit, and an image signal of the image to be displayed is transmitted to the corresponding data line according to the switching on state of the switching unit. Therefore, through switching on the switching unit, two rows of gate lines connected to the switching unit perform scanning simultaneously, the data lines to which the two rows of gate lines correspond receive the image signal, accordingly, the display resolution of the display panel is reduced, and the display power consumption of the display panel is decreased.

Optionally, the display mode is an ultra-high-definition display mode, a full-high-definition display mode, or a high-definition display mode.

Optionally, the second determining unit is configured to:

in a case where the resolution of the image to be displayed is greater than or equal to a maximum resolution of the display panel, determine that the display mode to which the resolution of the image to be displayed corresponds is the ultra-high-definition display mode;

in a case where the resolution of the image to be displayed is less than the maximum resolution of the display panel and greater than or equal to a half of the maximum resolution of the display panel, determine that the display mode to which the resolution of the image to be displayed corresponds is the full-high-definition display mode;

in a case where the resolution of the image to be displayed is less than a half of the maximum resolution of the display panel and greater than or equal to one third of the maximum resolution of the display panel, determine that the display mode to which the resolution of the image to be displayed corresponds is the high-definition display mode.

Optionally, after determining that the display mode to which the resolution of the image to be displayed corresponds is the ultra-high-definition display mode, the second determining unit is further configured to:

in a case where a user instruction message is received to change the display mode into the full-high-definition display mode, determine that the display mode to which the resolution of the image to be displayed corresponds is the full-high-definition display mode;

in a case where a user instruction message is received to change the display mode into the high-definition display mode, determine that the display mode to which the resolution of the image to be displayed corresponds is the high-definition display mode.

Optionally, after determining that the display mode to which the resolution of the image to be displayed corresponds is the full-high-definition display mode, the second determining unit is further configured to:

in a case where a user instruction message is received to change the display mode into the high-definition display mode, determine that the display mode to which the resolution of the image to be displayed corresponds is the high-definition display mode.

Optionally, the first control unit is configured to:

in a case where the display mode is the ultra-high-definition display mode, control each switching unit to be switched off, and transmit an image signal of the image to be displayed to each data line;

in a case where the display mode is the full-high-definition display mode, control switching units in odd-numbered rows to be switched on and switching units in even-numbered rows to be switched off, and transmit an image signal of the image to be displayed to data lines in odd-numbered rows; or, control switching units in odd-numbered rows to be switched off and control switching units in even-numbered rows to be switched on, and transmit an image signal of the image to be displayed to data lines in even-numbered rows;

in a case where the display mode is the high-definition display mode, control first and second switching units within each group of switching units to be switched on and a third switching unit within each group of switching units to be switched off, and transmit an image signal of the image to be displayed to first, fifth, and ninth data lines within each group of data lines, each group of switching units including three adjacent switching units in each column, each group of data lines including every nine adjacent data lines.

Optionally, in a case where the switching units are N-type thin film transistors, a signal controlling the switching units to be switched on is a high level, a signal controlling the switching units to be witched off is a low level; in a case where the switching units are P-type thin film transistors, a signal controlling the switching units to be switched on is a low level, a signal controlling the switching units to be switched off is a high level.

Optionally, the driving device further comprises:

a receiving unit configured to receive a voltage signal of an image to be displayed which is transmitted by a signal source;

an image display mode determining unit configured to determine current image display mode based on a voltage signal of an image to be displayed of two adjacent frames; and a second control unit configured to, in a case where the image display mode is a static display mode, based on a resolution of the image to be displayed, determine a switching unit that needs to be switched off and control each switching unit to be switched on or off, and output an image signal to a corresponding data line based on an on/off state of the switching unit.

The driving device for the display panel according to the embodiment of the present disclosure can further determine the image display mode of the image to be displayed through the voltage signal of the image to be displayed, thereby when it is determined that the image display mode of the image to be displayed is the static display mode, based on the resolution of the image, the switching unit that needs to be switched off is determined, a control signal for controlling the switching off of the switching unit is transmitted to the corresponding switching unit, meanwhile, the image signal is transmitted to the corresponding data signal according to the state of the switching unit; so that when the image display mode of the image to be displayed is the static display mode, through the switching off of the switching unit, the display resolution of the display panel changes from low to high, to increase the resolution of the image to be displayed during static displaying, thereby user experience is improved.

Optionally, the second control unit is further configured to:

in a case where the image display mode is a dynamic display mode, increase a frame frequency for image transmission.

Optionally; the image display mode determining unit is configured to:

in a case where the voltage signal of the image to be displayed is the same with a voltage signal of an image displayed in a previous frame, determine the current image display mode as the static display mode;

in a case where the voltage signal of the image to be displayed is different from a voltage signal of an image displayed in a previous frame, determine the current image display mode as the dynamic display mode.

Optionally, the second control unit is configured to:

in a case where the image display mode is the static display mode, and the resolution of the image to be displayed is less than the maximum resolution of the display, panel and greater than or equal to a half of the maximum resolution of the display panel, control each switching unit to be switched off, and transmit an image signal of the image to be displayed to each data line;

in a case where the display mode is the static image display mode, and the resolution of the image to be displayed is less than a half of the maximum resolution of the display panel and greater than or equal to one third of the maximum resolution of the display panel, control each switching unit to be switched off, and transmit an image signal of the image to be displayed to each data line; or, control switching units in odd-numbered rows to be switched on and control switching units in even-numbered rows to be switched off, and transmit an image signal of the image to be displayed to data lines in odd-numbered rows; or, control switching units in odd-numbered rows to be switched off and control switching units in even-numbered rows to be switched on, and transmit an image signal of the image to be displayed to data lines in even-numbered rows.

A driving device for the display panel according to another embodiment of the present disclosure comprises:

a receiving unit configured to receive a voltage signal of an image to be displayed which is transmitted by a signal source;

an image display mode determining unit configured to determine current image display mode based on a voltage signal of an image to be displayed of two adjacent frames; and a second control unit configured to, in a case where the image display mode is a static display mode, based on a resolution of the image to be displayed, determine a switching unit that needs to be switched off; and output an image signal to a corresponding data line based on an on/off state of the switching unit.

The driving device for the display panel according to another embodiment of the present disclosure can further determine the image display mode of the image to be displayed through the voltage signal of the image to be displayed, thereby when it is determined that the image display mode of the image to be displayed is the static display mode, the switching unit that needs to be switched off is determined based on the resolution of the image, a control signal for controlling the switching off of the switching unit is transmitted to the corresponding switching unit, meanwhile, the image signal is transmitted to the corresponding data signal according to the state of the switching unit, so that when the image display mode of the image to be displayed is the static display mode, through the switching off of the switching unit, the display resolution of the display panel changes from low to high, to increase the resolution of the image to be displayed during static displaying, thereby user experience is improved.

Optionally, the second control unit is further configured to:

in a case where the image display mode is a dynamic display mode, increase a frame frequency for image transmission.

Optimally, the image display mode determining unit is configured to:

in a case where the voltage signal of the image to be displayed is the same with a voltage signal of an image displayed in a previous frame, determine the current image display mode as the static display mode;

in a case where the voltage signal of the image to be displayed is different from a voltage signal of an image displayed in a previous frame, determine the current image display mode as the dynamic display mode.

Optionally, the second control unit is configured to:

in a case where the image display mode is the static display mode, and the resolution of the image to be displayed is less than the maximum resolution of the display panel and greater than or equal to a half of the maximum resolution of the display panel, control each switching unit to be switched off, and transmit an image signal of the image to be displayed to each data line;

in a case where the display mode is the static image display mode and the resolution of the image to be displayed is less than a half of the maximum resolution of the display panel and greater than or equal to one third of the maximum resolution of the display panel, control each switching unit to be switched off, and transmit an image signal of the image to be displayed to each data line; or, control switching units in odd-numbered rows to be switched on and control switching units in even-numbered rows to be switched off, and transmit an image signal of the image to be displayed to data lines in odd-numbered rows; or, control switching units in odd-numbered rows to be switched off and control switching units in even-numbered rows to be switched on, and an image signal of the image to be displayed is transmitted to data lines in even-numbered rows.

DETAILED DESCRIPTION OF THE EMBODIMENTS

In order to make the objects, technical solutions, and advantages of the present application to be more apparent, hereinafter, the present disclosure will be described in detail in conjunction with the drawings. Obviously, the described embodiments are merely parts of the embodiments of the present disclosure, rather than all of the embodiments thereof. All the other embodiments obtained by those of ordinary skill in the art based on the embodiments of the present disclosure without creative efforts fall into the protection scope of the present disclosure.

First Embodiment

Figure 1:
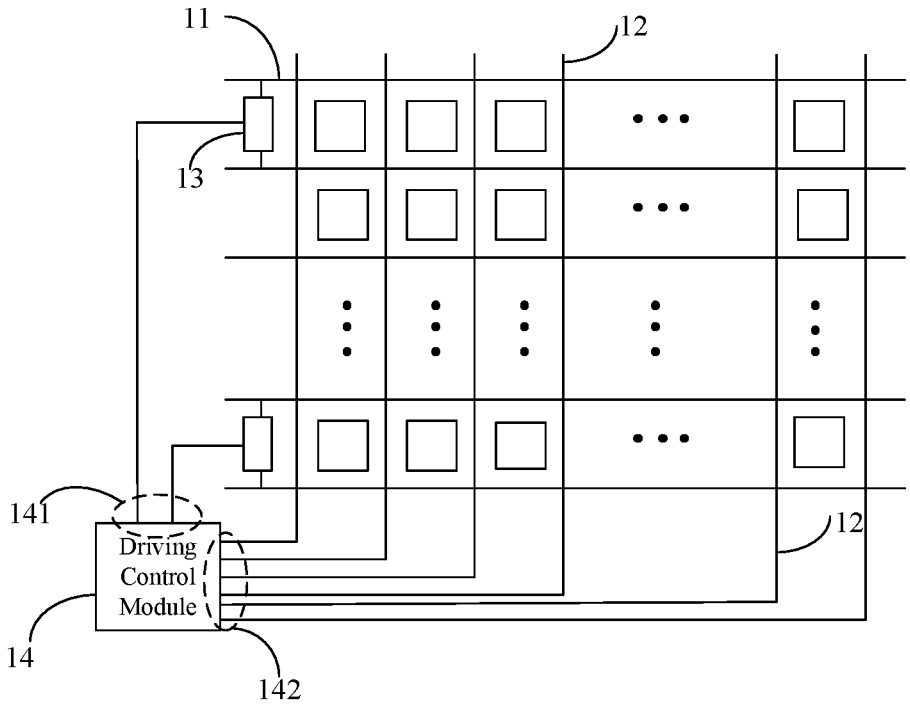
FIG. 1 is a schematic diagram of structure of the display panel according to an embodiment of the present disclosure.

FIG. 1 shows a display panel according to an embodiment of the present disclosure, comprising gate lines 11 and data lines 12 disposed across to each other. The display panel further comprises at least one switching unit 13 (only a few is shown in FIG. 1, but the connection manner is not limited to that in FIG. 1) connected between different gate lines 11, and the switching unit 13 is configured to control whether at least two rows of gate lines 11 are conducted. Blocks included in a region set by the data lines and the gate lines across to each other indicate sub-pixel cells. The display panel further comprises a driving control module 14 connected to a control terminal of the switching unit and input terminals of the data lines. The driving control module 14 comprises first output terminals 141 connected one by one to the control terminals of the switching units, wherein the driving control module 14 outputs, via the first output terminals 141, a control signal for controlling whether the corresponding switching unit 13 is switched on. The driving control module 14 further comprises second output terminals 142 connected one by one to the input terminals of the data lines, wherein the driving control module 14 decides whether to output an image signal to a corresponding data line via the second output terminals 142 based on an on/off state of the switching unit 13.

It should be noted that, in the embodiment of the present disclosure, setting at least one switching unit between different gate lines means that one switching unit may be set between a pair of two adjacent rows of gate lines in the display panel, or that one switching unit may be set respectively between several pairs of two adjacent rows of gate lines, or that one switching unit may be set between each pair of two adjacent rows of gate lines. However, as to how many switching units are to be set, the present disclosure makes no limitations. In addition, the switching unit is configured to control two rows of gate lines to be conducted, to which the switching unit are connected, so that the two rows of gate lines perform scanning concurrently. And thus, the switching unit may be set only between two adjacent rows of gate lines.

When one switching unit is switched on, the two rows of gate lines connected to the switching units are conducted, so that the two rows of gate lines concurrently scan subpixel cells to which the two rows of gate lines correspond. According to the switching on state of the switching unit, when an image signal is inputted to the data lines, it only needs to input to one data line to which the two rows of gate lines correspond. Inputting to one data line to which the two rows of gate lines correspond may be that the image signal is inputted to one of the first two data lines if the first two rows of gate lines are conducted.

In the display panel according to the embodiment of the present disclosure; at least one switching unit is provided between different gate lines to control whether at least two rows of gate lines are conducted. The switching units are connected one by one to the second output terminals of the driving control module to receive a control signal outputted by the driving control module for controlling whether to switch on the switching unit; the data lines in the display panel are connected one by one to the second output terminals of the driving control module to receive an image signal outputted by the driving control module. When the switching unit receives the control signal outputted by the driving control module via the first output terminals for controlling the switching unit to be switched on, the switching unit is switched on, so that two rows of gate lines connected to the switching unit perform scanning simultaneously; according to the switching on state of the switching unit, the driving control module outputs the image signal to the data lines to which the two rows of gate lines correspond, so that the display resolution of the display panel is reduced, and the display power consumption of the display panel is decreased.

Figure 2:
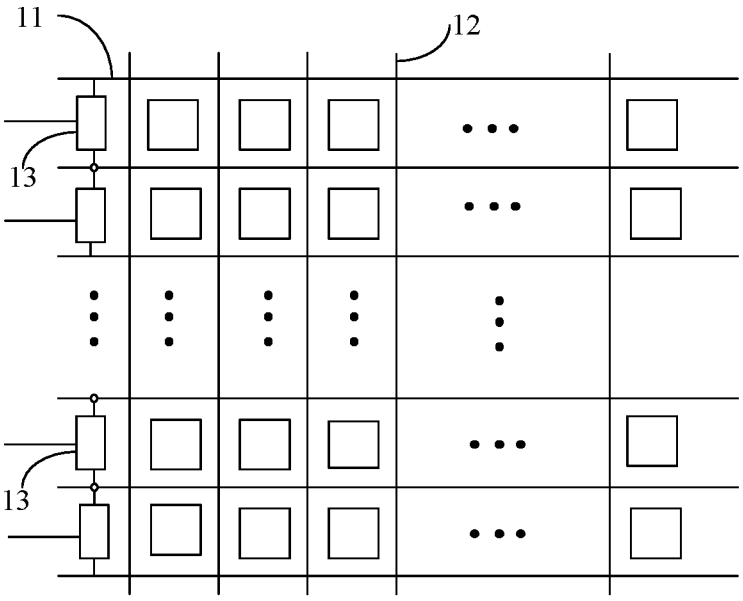
FIG. 2 is a schematic diagram of structure of the display panel according to an embodiment of the present disclosure.

Referring to FIG. 2, the switching unit 13 is provided between each pair of two adjacent rows of gate lines 11.

By means of providing a switching unit between each pair of two adjacent rows of gate lines, and based on switching on of the switching unit, the display resolution of the display panel is reduced to a larger extent, and the display power consumption of the display panel is decreased.

Figure 3:
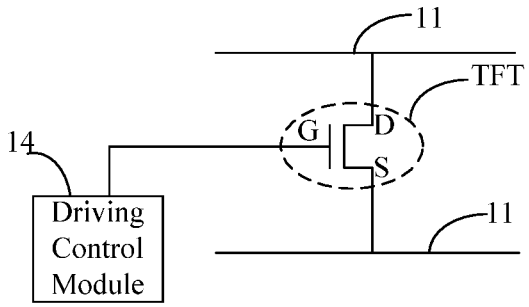
FIG. 3 is a schematic diagram of structure of the switching unit according to an embodiment of the present disclosure.

Referring to FIG. 3, the switching unit 13 is a thin film transistor (TFT). For each thin film transistor, a source (S) and a drain (D) of the thin film transistor are connected respectively to two rows of gate lines 11 adjacent to the thin film transistor, and a gate (G) of the thin film transistor is connected to a first output terminal of the driving control module 14.

It should be noted that the switching unit is used to make the two adjacent rows of gate lines conducted. Therefore, the switching unit in the present disclosure is not limited to the thin film transistor. Any device capable of making the two rows of gate lines connected to the switching unit conducted via the control signal belongs to the protection scope of the present disclosure.

The driving control module 14 is configured to:

determine a display mode to which the resolution of the image to be displayed corresponds, based on a resolution of an image to be displayed which is transmitted by a signal source; and based on the display mode, determine switching units that need to be switched on and switched off, and output via the first output terminals a control signal for controlling whether to switch on a corresponding switching unit, and output via the second output terminals an image signal to a corresponding data line based on an on/off state of the switching unit.

It should be noted that the driving control module in the embodiment of the present disclosure is a driving IC (DIC) or a Gate IC for driving a gate. Of course, in the embodiment of the present disclosure, determining a display mode to which the resolution of the image to be displayed corresponds based on a resolution of an image to be displayed which is transmitted by a signal source may be executed by the driving IC or the Gate IC or an application processor (A), the present disclosure makes no limitation thereto.

The image to be displayed in the embodiment of the present disclosure refers to an image that is to be displayed by the panel but has not yet been displayed, and the image signal refers to image content that needs to be displayed on the display panel of the image to be displayed.

By controlling the switching unit and the data lines by the driving control module, the display resolution of the display panel is reduced, and the display power consumption of the display panel is decreased. The driving control module determines, based on a resolution of an image to be displayed which is transmitted from a signal source, a display mode to which the resolution of the image to be displayed corresponds, and then determines; based on the display mode, switching units that need to be switched on and switched off, and outputs a control signal to each switching unit, and outputs an image signal of the image to be displayed to a corresponding data line based on an on/off state of the switching unit.

The driving control module 14 is further configured to:

receive a voltage signal of an image to be displayed which transmitted by a signal source;

determine current image display mode based on a voltage signal of an image to be displayed of two adjacent frames, wherein the image display mode is a static display mode or a dynamic display mode; and in a case where the image display mode is the static display mode, based on a resolution of the image to be displayed, determine a switching unit that needs to be switched off, and output via the first output terminals a control signal for controlling a corresponding switching unit is to be switched on or switched off and output via the second output terminals an image signal to a corresponding data line based on an on/off state of the switching unit.

In the embodiment of the present disclosure, the static display mode may be a mode for displaying static information such as a static picture or text, and the dynamic display mode may be a mode for displaying information such as a dynamic picture or a video.

The driving control module in the display panel according to the embodiment of the present disclosure can be further used to: receive a voltage signal of an image to be displayed which is transmitted by a signal source; determine an image display mode of the image to be displayed based on the voltage signal; when the image display mode is determined as a static display mode, based on a resolution of the image to be displayed, the driving control module determines the switching unit that needs to be switched off, and outputs a control signal for controlling a corresponding switching unit to be switched off to the corresponding switching unit, and outputs an image signal to a corresponding data line based on the state of the switching unit. Thus, when the image display mode of the image to be displayed is the static display mode, by switching off the switching unit, the display resolution in the display panel can change from low to high so that the resolution of the image to be displayed during static displaying is increased and user experience is improved.

The driving control module 14 is further configured to:

in a case where the image display mode is a dynamic display mode, increase a frame frequency for image transmission.

When the driving control module determines that the image display mode is a dynamic display mode, a frame frequency for image transmission is increased, so that fluency when the display panel displays a dynamic image such as video is improved, and user experience is improved.

To sum up, in the display panel according to the embodiment of the present disclosure, at least one switching unit is provided between different gate lines to control whether at least two rows of gate lines are conducted; each switching unit is connected one by one to first output terminals of the driving control module to receive a control signal outputted by the driving control module for controlling whether to switch on the switching unit; each data line in the display panel is connected one by one to the second output terminals of the driving control module to receive an image signal outputted by the driving control module. When the switching unit receives a control signal outputted by the driving control module via the first output terminals for controlling the switching unit to be switched on, the switching unit is switched on, so that two rows of gate lines connected to the switching unit perform scanning simultaneously, and meanwhile, according to the switching on state of the switching unit, the driving control module outputs the image signal to the data lines to which the two rows of gate lines correspond, so that the display resolution of the display panel is reduced, and the display power consumption of the display panel is decreased. In addition; the driving control module further receives a voltage signal of an image to be displayed which is transmitted by a signal source, and determines an image display mode of the image to be displayed based on the voltage signal. When the image display mode is determined as a static display mode, based on a resolution of the image to be displayed, the driving control module determines the switching unit that needs to be switched off, and outputs a control signal for controlling a corresponding switching unit to be switched off to the corresponding switching unit, and outputs an image signal to a corresponding data line based on the state of the switching unit. When the image display mode of the image to be displayed is the static display mode, the frame frequency is improved for transmitting the image. Thus; when the image display mode of the image to be displayed is determined as the static display mode, by switching off the switching unit, the display resolution in the display panel changes from low to high, so that the resolution of the image to be displayed during static displaying is increased and user experience is improved, and when it is determined that the image display mode of the image to be displayed is a dynamic display mode, a frame frequency for image transmission is increased, so as to improve fluency when the display panel displays a dynamic image such as video. Therefore, the display panel is capable of automatically determining the image display mode of the image to be displayed, automatically decreasing the resolution of the image to be displayed or automatically increasing the resolution of the image to be displayed, so that, based on the image display mode of the to be-displayed image, resolution of the image in the static display mode can be increased, or fluency of the image in the dynamic display mode can be improved and in turn user experience is improved.

Figure 4:
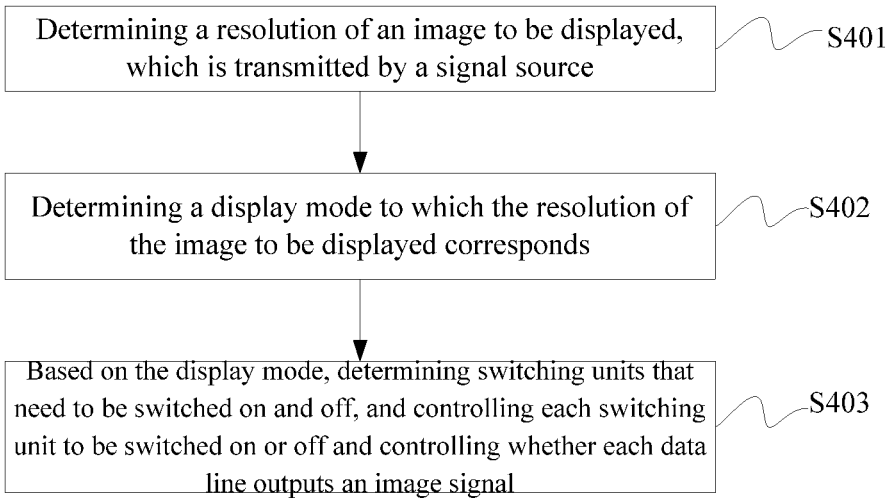
FIG. 4 is a schematic flowchart of the driving method for the display panel according to an embodiment of the present disclosure.

FIG. 4 is a driving method for the display panel according to an embodiment of the present disclosure. The method comprises:

S401 wherein a resolution of an image to be displayed which is transmitted from a signal source is determined;

S402 wherein a display mode to which the resolution of the image to be displayed corresponds is determined; and S403 wherein, based on the display mode; switching units that need to be switched on and switched off are determined, and each switching unit is controlled to be switched on or switched off and whether each data line outputs an image data is controlled.

In step S401, a resolution of the image can calculated based on received image information of an image to be displayed which is transmitted from a signal source so that a resolution of image to be displayed transmitted from the signal source is determined.

In step S402, the display mode may be an ultra-high-definition display mode, a full-high-definition display mode, or a high-definition display mode.

In the embodiment of the present disclosure, a resolution to which the ultra-high-definition display mode corresponds may be 2160*3840, wherein 3840 is the number of pixels in rows, and 2160 is the number of pixels in columns; a resolution to which the ultra-high-definition display mode corresponds may be 11.080*1920, wherein 1920 is the number of pixels in rows, and 1080 the number of pixels in columns; and a resolution to which the high-definition display mode corresponds may be 720*1280, wherein 1280 is the number of pixels in rows; and 720 is the number of pixels in columns.

Further, in step S402, in a case where the resolution of the image to be displayed is greater than or equal to a maximum resolution of the display panel, it is determined that the display mode to which the resolution of the image to be displayed corresponds is the ultra-high-definition display mode;

in a case where the resolution of the image to be displayed is less than the maximum resolution of the display panel and greater than or equal to a half of the maximum resolution of the display panel, it is determined that the display mode to which the resolution of the image to be displayed corresponds is the full-high-definition display mode; and in a case where the resolution of the image to be displayed is less than a half of the maximum resolution of the display panel and greater than or equal to one third of the maximum resolution of the display panel, it is determined that the display mode to which the resolution of the image to be displayed corresponds is the high-definition display mode.

In the embodiment of the present disclosure, the display panel may be an ultra-high-definition display panel. For example, the resolution of the display panel may be 2160*3840, wherein 3840 is the number of pixels in rows and 2160 is the number of pixels in columns. In this case, a maximum resolution of the display panel is 2160*3840; a half resolution of the maximum resolution is 1080*1920, wherein 1920 is the number of pixels in rows and 1080 is the number of pixels in columns; and one third resolution of the maximum resolution is 720*1280, wherein 1280 is the number of pixels in rows and 720 is the number of pixels in columns.

Of course, for the full-high-definition display panel whose maximum resolution is 1080*1920, the structure and driving method of the display panel in the embodiment of the present disclosure are also applicable. The display panel in the embodiment of the present disclosure may also be an ultra-high-definition display panel or a full-high-definition display panel, and the present application makes no limitations thereto.

After it is determined that the display mode to which the resolution of the image to be displayed corresponds is the ultra-high-definition display mode, the method further comprises:

in a case where a user instruction message is received to change the display mode into the full-high-definition display mode, determining that the display mode to which the resolution of the image to be displayed corresponds is the full-high-definition display mode;

in a case where a user instruction message is received to change the display mode into the high-definition display mode, determining that the display mode to which the resolution of the image to be displayed corresponds is the high-definition display mode.

After it is determined that the display mode to which the resolution of the image to be displayed corresponds is the full-high-definition display mode, the method further comprises:

in a case where a user instruction message is received to change the display mode into the high-definition display mode, determining that the display mode to which the resolution of the image to be displayed corresponds is the high-definition display mode.

The user instruction message for changing the display mode into the high-definition display mode may be provided to the user for selecting in form of a pop-up interface in the display panel, and the user instruction message may be either selected by the user during the display process, or selected by the user before the display panel displays the image to be displayed. The present disclosure makes no limitations to the form of and time for providing the user instruction message.

The resolution of the image to be displayed may be decreased when being displayed as needed. For example, when the image to be displayed is a dynamic video, the resolution of the image to be displayed may be decreased properly, so as to reduce display power consumption of the display panel. If the resolution of the panel to be displayed is 2160*3840, the resolution may be decreased to 1080*1920 or 720*1280 by the driving IC or the application processor based on algorithms. And then the display resolution of the display panel is reduced through a control signal transmitted by the driving or a control signal for controlling switched on/off of the switching unit transmitted by the Gate IC, and display power consumption for displaying the dynamic video is decreased.

Step S403 may comprises:

in a case where the display mode is the ultra-high-definition display mode, each switching unit is controlled to be switched off, and an image signal of the image to be displayed is transmitted to each data line;

in a case where the display mode is the full-high-definition display mode, switching units in odd-numbered rows are controlled to be switched on and switching units in even-numbered rows are controlled to be switched off, and an image signal of the image to be displayed is transmitted to data lines in odd-numbered rows; or, switching units in odd-numbered rows are controlled to be switched off and switching units in even-numbered rows are controlled to be switched on, and an image signal of the image to be displayed is transmitted to data lines in even-numbered rows;

in a case where the display mode is the high-definition display mode, a first switching unit and a second switching unit within each group of switching units are controlled to be switched on and a third switching unit within each group of switching units is controlled to be switched off, and an image signal of the image to be displayed is transmitted to a first data line, a fifth data line, and a ninth data line within each group of data lines, each group of switching units including three adjacent switching units in each column and each group of data lines including every nine adjacent data lines, wherein the date lines included in each group may be different.

In a case where the switching units are N-type thin film transistors, a signal controlling the switching units to be switched on is a high level, and a signal controlling the switching units to be switched off is a low level. In a case where the switching units are P-type thin film transistors, a signal controlling the switching units to be switched on is a low level and a signal controlling the switching units to be switched off is a high level.

Next, the method will be described in more details in conjunction with FIGS. 5 and 6.

Figure 6:
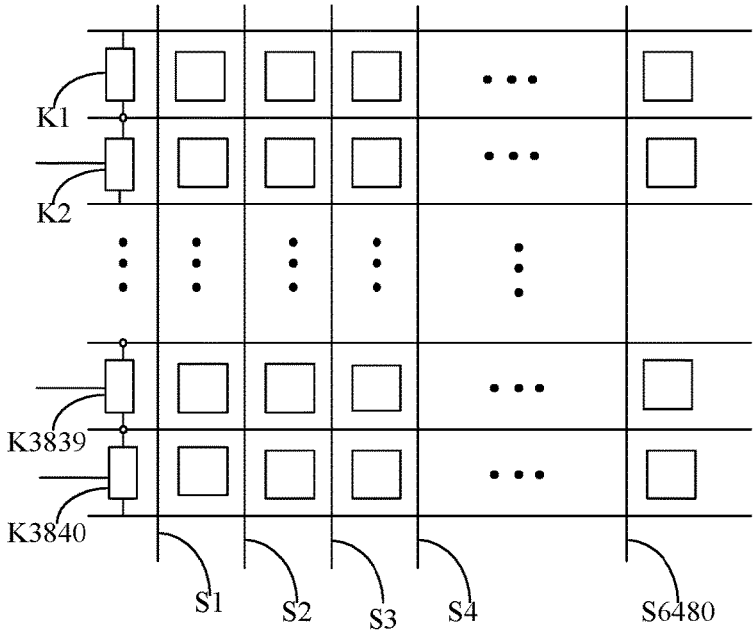
FIG. 6 is a schematic diagram of structure of the display panel according to an embodiment of the present disclosure.

FIG. 6 shows a structure of the display panel according to an embodiment of the present disclosure. In FIG. 6, K represents the switching unit, S represents the data line. For example, K1 represents a first switching unit arranged from top to bottom in the display panel, and S1 represents a first data line arranged from left to right in the display panel. As an example, the display panel is an ultra-high-definition display panel, wherein the number of pixels in rows is 3840 and the number of pixels in columns is 6480. In FIG. 6, blocks included in the regions set by intersecting data lines and the gate lines represent subpixel cells.

Figure 5:
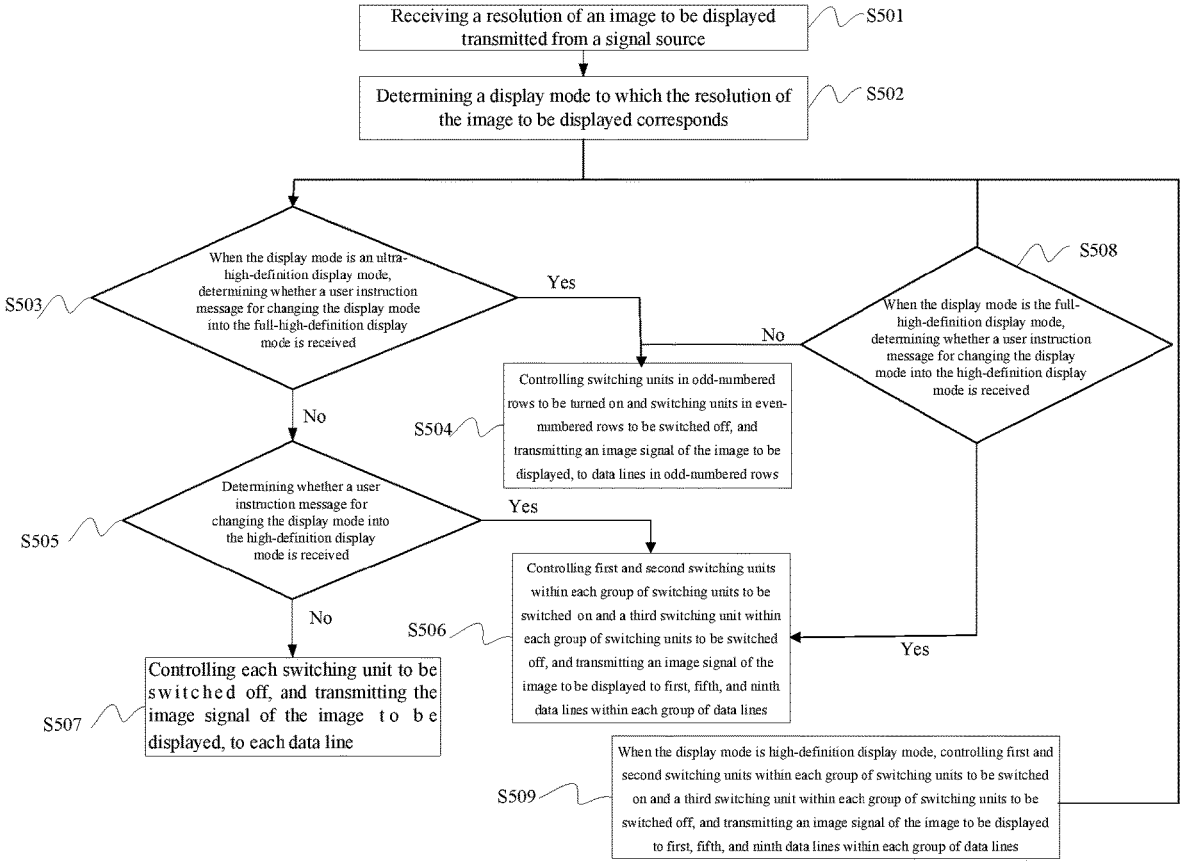
FIG. 5 is a schematic flowchart of the driving method for the display panel according to an embodiment of the present disclosure.

FIG. 5 shows a driving method for the display panel according to an embodiment of the present disclosure.

In step S501, a resolution of a to-be-displayed signal source is received.

In step S502, a display mode to which the resolution of the to-be-displayed signal source corresponds is determined In step S503, when the display mode is an ultra-high-definition display mode, it is determined whether a user instruction message for changing the display mode into the full-high-definition display mode is received; if yes, step S504 is executed, otherwise step S505.

In step S504, switching units in odd-numbered rows are controlled to be switched on and switching units in even-numbered rows are controlled to be switched off, and an image signal of the image to be displayed is transmitted to data lines in odd-numbered rows; or, switching units in odd-numbered rows are controlled to be switched off and switching units in even-numbered rows are controlled to be switched on, and an image signal of the image to be displayed is transmitted to data lines in even-numbered rows.

Referring to FIG. 6, the first output module of the control driving module controlled to output a control signal for controlling each of K1, K3, K5 . . . K3835, K3837, K3839 to be switched on and a control signal for controlling each of K2, K4, K6 . . . K3836, K3838, K3840 to be switched off, and meanwhile, an image signal of the image to be displayed is transmitted to data lines S1, S3, S5 . . . S6475, S6477, S6479; or, the first output module of the control driving module is controlled to output a control signal for controlling each of K1, K3, K5 . . . K3835, K3837, K3839 to be switched off and a control signal for controlling each of K2, K4, K6 . . . K3836, K3838, K3840 to be switched on, and meanwhile, an image signal of the image to be displayed is transmitted to data lines S2, S4, S6 . . . S6476, S6478, S6480.

In step S505, it is determined whether a user instruction message for changing the display mode into the high-definition display mode is received; if yes, step S506 is executed, otherwise step S507.

In step S506, the first and second switching units within each group of switching units are controlled to be switched on and the third switching unit within each group of switching units is controlled to be switched off, and an image signal of the image to be displayed is transmitted to the first, fifth, and ninth data lines within each group of data lines.

Each group of switching units includes three adjacent switching units in each column, wherein the switching units included by different groups may be different. Each group of data lines includes every nine adjacent data lines, and the date lines included by different groups may be different.

It should be noted that the purpose of building a group of data lines by nine adjacent data lines is to ensure the finally retained data lines to be a complete RGB structure, as well as a ratio between the output signal terminals and the resolution aspect ratios which meets the three resolutions of the ultra-high-definition display mode, the full-high-definition display mode and the high-definition display mode.

Referring to FIG. 6, the first output terminals of the control driving module are controlled to output a control signal for controlling each of K1, K2, K4, K5 . . . K3835, K3836, K3839, K3840 to be switched on and a control signal for controlling each of K3, K6, K9 . . . K3831, K3834, K3837 to be switched off, and meanwhile, an image signal of the image to be displayed is transmitted to data lines S1, S5, S9 . . . S6472, S6476, S6480.

In step S507, each switching unit is controlled to be switched off, and the image signal of the image to be displayed is transmitted to each data line.

Referring to FIG. 6, the first output terminals of the control driving module are controlled to output a control signal for controlling each of K1, K2, K3, K4 . . . K3837, K3838, K3839, K3840, the image signal of the image to be displayed is transmitted to each data line.

In step S508, in a case where the display mode is the full-high-definition display mode, it is determined whether a user instruction message for changing the display mode into the high-definition display mode is received; if yes, step S506 is executed, otherwise step S504 is executed.

In step S509, the first and second switching units within each group of switching units are controlled to be switched on and the third switching unit within each group of switching units is controlled to be switched off, and an image signal of the image to be displayed is transmitted to the first, fifth, and ninth data lines within each group of data lines, wherein the switching on states are the same with those in step S506.

According to the above, when the display mode of the image to be displayed is the ultra-high-definition display mode, the display mod of the image can be reduced to the full-high-definition display mode or the high-definition display mode as required, and a reduction of the display resolution of the display panel can be achieved by switching on the switching units, so as to reduce the display resolution of the image to be displayed in the display panel as well as the display power consumption of the display panel. When the display mode of the image is the full-high-definition display mode, the display mode of the image can be reduced to the high-definition display mode as required, and a reduction of the display resolution of the display panel can be achieved by switching on the switching units, so as to reduce the display resolution of the image to be displayed in the display panel as well as the display power consumption of the display panel.

Figure 7:
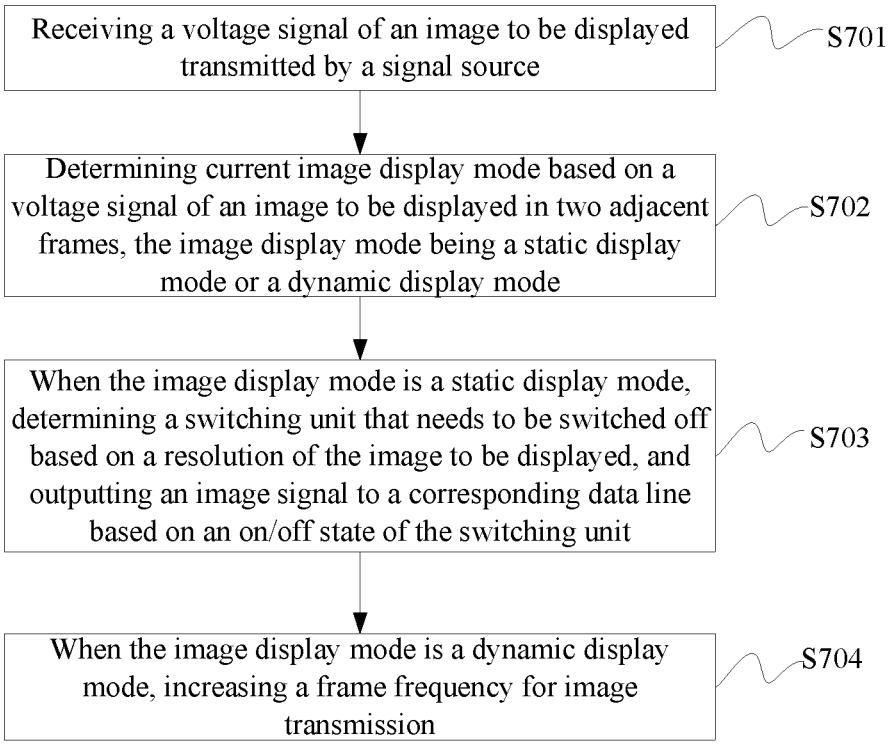
FIG. 7 is a schematic flowchart of the driving method for the display panel according to an embodiment of the present disclosure.

Referring to FIG. 7, the driving method for the display panel further comprises:

S701, wherein a voltage signal of an image to be displayed which is transmitted by a signal source is received;

S702, wherein current image display mode is determined based on a voltage signal of an image to be displayed of two adjacent frames, wherein the image display mode is a static display mode or a dynamic display mode;

S703, wherein, in a case where the image display mode is a static display mode, based on a resolution of the image to be displayed, a switching unit that needs to be switched off is determined and each switching unit is controlled to be switched on or off, and an image signal is outputted to a corresponding data line based on an on/off state of the switching unit; and S704, wherein a frame frequency for image transmission is increased in a case where the image display mode is a dynamic display mode.

In this embodiment, the two adjacent frames may be the frame when preparing the voltage signal for transmitting the image to be displayed and a previous frame of this frame.

Determining the current image display mode based on a voltage signal of an image to be displayed of two adjacent frames may comprise:

in a case where the voltage signal of the image to be displayed is the same with a voltage signal of an image displayed in a previous frame, determining the current image display mode as the static display mode;

in a case where the voltage signal of the image to be displayed is different from a voltage signal of an image displayed in a previous frame, determining the current image display mode as the dynamic display mode.

It should be noted that, when determining the image display mode, the comparison may also be performed based on the voltage signal of the image to be displayed and a voltage of an already displayed image in the previous frame or previous two frames or previous more frames. In other words, the present disclosure is not limited to a comparison only with the voltage signal of the previous frame.

In addition, step S703 may comprise:

in a case where the image display mode is the static display mode, and where the resolution of the image to be displayed is less than the maximum resolution of the display, panel but greater than or equal to a half of the maximum resolution of the display panel, controlling each switching unit to be switched off, and transmitting an image signal of the image to be displayed to each data line;

in a case where the display mode is the static image display mode, and where the resolution of the image to be displayed is less than a half of the maximum resolution of the display panel but greater than or equal to one third of the maximum resolution of the display panel, controlling each switching unit to be switched off, and transmitting an image signal of the image to be displayed to each data line; or, controlling switching units in odd-numbered rows to be switched on and switching units in even-numbered rows to be switched off, and transmitting an image signal of the image to be displayed to data lines in odd-numbered rows; or, controlling switching units in odd-numbered rows to be switched off and switching units in even-numbered rows to be switched on, and transmitting an image signal of the image to be displayed to data lines in even-numbered rows.

For example, when it is determined that the image display mode is the static display mode, in order to enhance user experience, the resolution of the image to be displayed may be increased to a resolution to which the full-high-definition display mode corresponds or to a resolution to which the ultra-high-definition display mode corresponds. For example, if the resolution of the image to be displayed is 720*1280, the resolution of the image to be displayed may be increased to 1080*1920 or 2160*3840 by algorithms.

Referring to the display panel shown in FIG. 6, the resolution of the image to be displayed is increased by switching on or off the switching unit. For example, in a case where the resolution of the image to be displayed is 7201280, in order to increase the resolution of the image to be displayed to 1080*1920, the first output terminals of the control driving module can be controlled to output a control signal for controlling each of K1, K3, K5 . . . K3835, K3837, K3839 to be switched on and to output a control signal for controlling each of K2, K4, K6 . . . K3836, K3838, K3840 to be switched off, and meanwhile, the image signal of the image to be displayed is transmitted to data lines S1, S3, S5 . . . S6475, S6477, S6479; or the first output terminals of the control driving module can be controlled to output a control signal for controlling each of K1, K3, K5 . . . K3835, K3837, K3839 to be switched off, and to output a control signal for controlling each of K2, K4, K6 . . . K3836, K3838, K3840 to be switched on, and meanwhile, the image signal of the image to be displayed is transmitted to data lines S2, S4, S6 . . . S6476, S6478, S6480.

As another example, in order to increase the resolution of the image to be displayed to 2160*3840, the first output terminals of the control driving module can be controlled to output a control signal for controlling each of K1, K2, K3. K4 . . . K3837, K3838, K3839, K3840 to be switched off, and meanwhile, the image signal of the image to be displayed is transmitted to each data line.

By the above driving method, the image display mode of the image to be displayed is determined according to the voltage signal of the image to be displayed. Thus, when it is determined that the display mode of the image to be displayed is the static image mode, the switching unit that needs to be switched off are determined based on the resolution of the image, and the control signal for controlling to switch off the switching unit is transmitted to the corresponding switching unit, and meanwhile the image signal is transmitted to the corresponding data line based on the state of the switching unit, so that when the display mode of the image to be displayed is the static image mode, through the switching off of the switching unit, the display resolution in the display panel changes from low to high, and accordingly, the resolution of the image to be displayed during static displaying is increased, user experience is improved. The driving method further comprises, when the image display mode of the image to be displayed is a dynamic display mode, increasing a frame frequency for image transmission so as to improve fluency when the display panel displays a dynamic image such as video. Thus, by means of automatically determining the image display mode of the image to be displayed, automatically decreasing the resolution of the image to be displayed or automatically increasing the resolution of the image to be displayed, based on the image display mode of the to be-displayed image, either resolution of the image in the static display mode is increased, or fluency of the image in the dynamic display mode is improved, so that user experience is improved.

Second Embodiment

Figure 8:
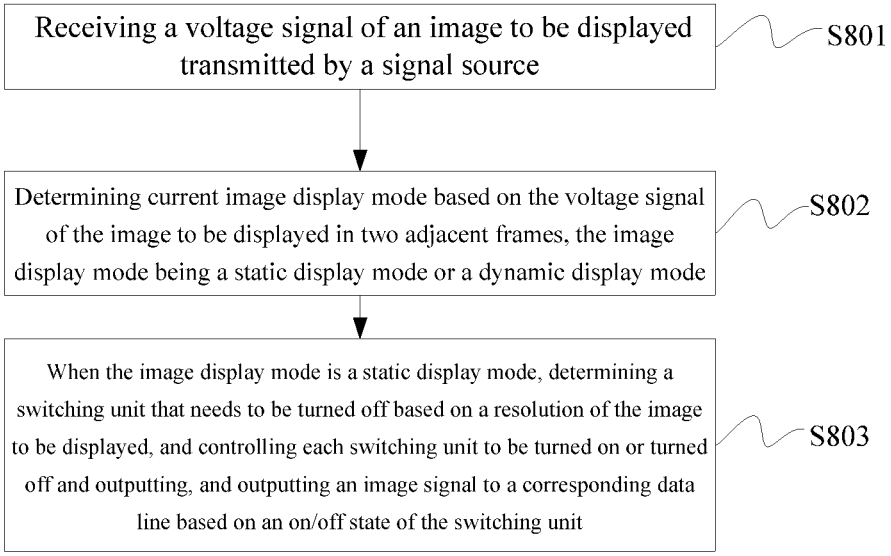
FIG. 8 is a schematic diagram of structure of the display panel according to another embodiment of the present disclosure.

FIG. 8 shows a driving method for the display panel according to an embodiment of the present disclosure, the method comprises:

S801, wherein a voltage signal of an image to be displayed which is transmitted by a signal source is received S802, wherein current image display mode is determined based on a voltage signal of an image to be displayed of two adjacent frames; and S803, wherein, in a case where the image display mode is a static display mode, based on a resolution of the image to be displayed, a switching unit that needs to be switched off is determined, and each switching unit is controlled to be switched on or switched off, and an image signal is outputted to a corresponding data line based on an on/off state of the switching unit In this embodiment, the two adjacent frames may be the frame when preparing the voltage signal for transmitting the image to be displayed and a previous frame of this frame.

Determining the current image display mode based on a voltage signal of an image to be displayed of two adjacent frames may comprise:

in a case where the voltage signal of the image to be displayed is the same with a voltage signal of an image displayed in a previous frame; determining the current image display mode as the static display mode;

in a case where the voltage signal of the image to be displayed is different from a voltage signal of an image displayed in a previous frame, determining the current image display mode as the dynamic display mode.

It should be noted that, when determining the image display mode, the comparison may also be performed based on the voltage signal of the image to be displayed and a voltage of an already displayed image in the previous frame or previous two frames or previous more frames. In other words, the present disclosure is not limited to a comparison only with the voltage signal of the previous frame.

In the embodiment of the present disclosure, the static display mode may be an image in a case where the display panel will not change such as in a state of reading or a static picture, and the dynamic display mode may be an image in a case where the display panel changes constantly such as in a state of a dynamic picture or a video.

In addition, step S803 may comprise:

in a case where the image display mode is the static display mode, and where the resolution of the image to be displayed is less than the maximum resolution of the display panel but greater than or equal to a half of the maximum resolution of the display panel, controlling each switching unit to be switched off, and transmitting an image signal of the image to be displayed to each data line;

in a case where the display mode is the static image display mode, and where the resolution of the image to be displayed is less than a half of the maximum resolution of the display panel but greater than or equal to one third of the maximum resolution of the display panel, controlling each switching unit to be switched off, and transmitting an image signal of the image to be displayed to each data line; or, controlling switching units in odd-numbered rows to be switched on and switching units in even-numbered rows to be switched off, and transmitting an image signal of the image to be displayed to data lines in odd-numbered rows; or, controlling switching units in odd-numbered rows to be switched off and switching units in even-numbered rows to be switched on, and transmitting an image signal of the image to be displayed to data lines in even-numbered rows.

For example, when it is determined that the image display mode is the static display mode, in order to enhance user experience, the resolution of the image to be displayed may be increased to a resolution to which the full-high-definition display mode corresponds or to a resolution to which the ultra-high-definition display mode corresponds. For example, if the resolution of the image to be displayed is 720*1280, the resolution of the image to be displayed may be increased to 1080*1920 or 2160*3840 by algorithms.

Referring to the display panel shown in FIG. 6, the resolution of the image to be displayed is increased by switching on or off the switching unit. For example, in a case where the resolution of the image to be displayed is 720*1280, in order to increase the resolution of the image to be displayed to 1080*1920, the first output terminals of the control driving module can be controlled to output a control signal for controlling each of K1, K3, K5 . . . K3835, K3837, K3839 to be switched on and to output a control signal for controlling each of K2, K4, K6, . . . , K3836, K3838, K3840 to be switched off, and meanwhile, the image signal of the image to be displayed is transmitted to data lines S1, S3, S5 . . . S6475, S6477, S6479; or the first output terminals of the control driving module can be controlled to output a control signal for controlling each of K1, K3, K5 . . . K3835, K3837, K3839 to be switched off, and to output a control signal for controlling each of K2, K4, K6 . . . K3836, K3838, K3840 to be switched on, and meanwhile, the image signal of the image to be displayed is transmitted to data lines S2, S4, S6 . . . S6476, S6478, S6480.

As another example, in order to increase the resolution of the image to be displayed to 2160*3840, the first output terminals of the control driving module can be controlled to output a control signal for controlling each of K1, K2, K3, K4 . . . K3837, K3838, K3839, K3840 to be switched off, and meanwhile, the image signal of the image to be displayed is transmitted to each data line.

The driving method may further comprise:

in a case where the image display mode is a dynamic display mode, increasing a frame frequency for image transmission.

By the above driving method, the image display mode of the image to be displayed is determined according to the voltage signal of the image to be displayed. Thus, when it is determined that the display mode of the image to be displayed is the static image mode, the switching unit that needs to be switched off are determined based on the resolution of the image, and the control signal for controlling to switch off the switching unit is transmitted to the corresponding switching unit, and meanwhile the image signal is transmitted to the corresponding data line based on the state of the switching unit, so that when the display mode of the image to be displayed is the static image mode, through the switching off of the switching unit, the display resolution in the display panel changes from low to high, and accordingly, the resolution of the image to be displayed during static displaying is increased, user experience is improved. The driving method further comprises, when the image display mode of the image to be displayed is a dynamic display mode, increasing a frame frequency for image transmission so as to improve fluency when the display panel displays a dynamic image such as video. Thus, by means of automatically determining the image display mode of the image to be displayed, automatically decreasing the resolution of the image to be displayed or automatically increasing the resolution of the image to be displayed, based on the image display mode of the to be-displayed image, either resolution of the image in the static display mode is increased, or fluency of the image in the dynamic display mode is improved, so that user experience is improved.

Figure 9:
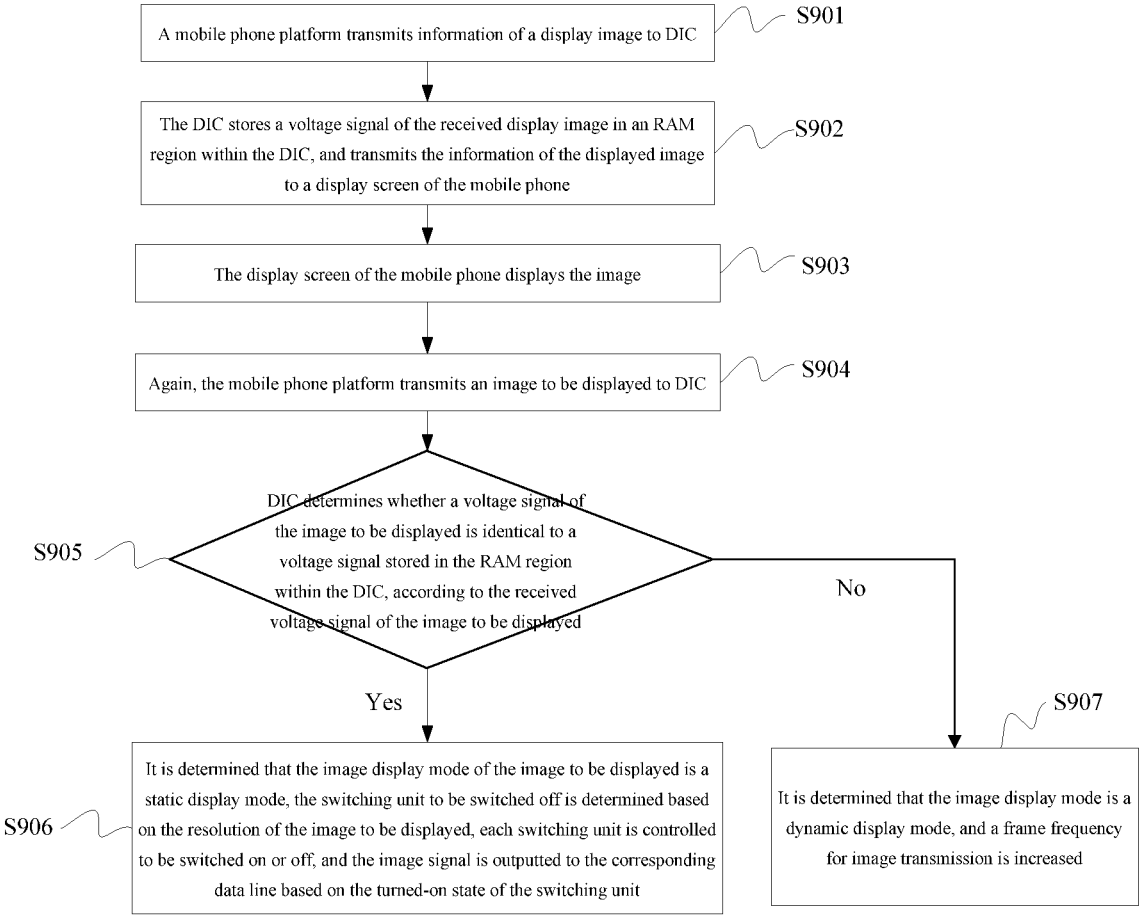
FIG. 9 is a schematic flowchart of the driving method for the display panel according to an embodiment of the present disclosure.

FIG. 9 shows a driving method for the display panel according to an embodiment of the present disclosure, wherein the display panel is a mobile phone and the driving control mode is a driving IC (DIC) or a Gate IC. However, it should be noted that the present disclosure of course is not limited to the case where the display panel is a mobile phone. Neither is it limited to the case where the driving module is a driving IC or a Gate IC The driving method comprises:

S901, wherein a mobile phone platform transmits information of a display image to INC;

S902, wherein the DIC stores a voltage signal of the received display image in an RAM region within the DIC, and transmits information of the display image to a display screen of the mobile phone;

S903, wherein the display screen of the mobile phone displays the image;

S904, wherein the mobile phone platform transmits again an image to be displayed to DIC;

S905, wherein INC compares a voltage signal of the image to be displayed with a voltage signal stored in the RAM region within the DIC; if they are identical, step S906 is executed; otherwise, step S907 is executed;

S906, wherein it is determined that the image display mode of the image to be displayed is a static display mode, then the switching unit that needs to be switched off is determined based on the resolution of the image to be displayed, each switching unit is controlled to be switched on or off, and the image signal is outputted to the corresponding data line based on the on/off state of the switching unit;

wherein when it is determined that the image display mode of the image to be displayed is a static display mode, the mobile phone platform does not transmit an image to INC any more, because the RAM within the DO has already stored information of the image, so that display power consumption in the static display mode is saved;

S907, wherein, when it is determined that the image display mode is a dynamic display mode, a frame frequency for image transmission is increased;

wherein when it is determined that the image display mode is a dynamic display mode, the mobile phone platform continues to transmit the image to be displayed to DIC, fluency when the display panel displays a dynamic image is improved by increasing a frame frequency for image transmission, so that user experience is improved.

To sum up, the driving method for the display panel provided by the embodiment of the present disclosure improves image display effect by means of determining the image display mode of the image to be displayed and increasing the resolution of the image in the static display mode through internal algorithms, and improving fluency when the display panel displays a dynamic image by increasing a frame frequency for image transmission. Therefore, by means of automatically determining the display mode and automatically change a frequency, an accurate differentiation point is provided for static displaying and dynamic displaying, at the same time, display effect is improved in a convenient, smart way.

Figure 10:
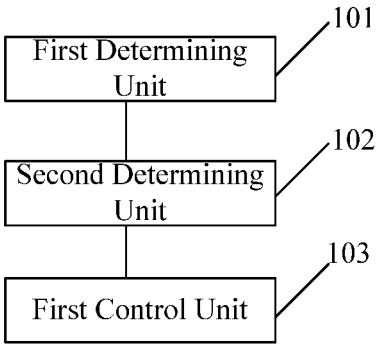
FIG. 10 is a schematic diagram of structure of the driving device for the display panel according to an embodiment of the present disclosure.

FIG. 10 shows a driving device for the display panel according to an embodiment of the present disclosure, the driving device comprises:

a first determining unit 101 configured to determine a resolution of an image to be displayed which is transmitted by a signal source;

a second determining unit 102 configured to determine a display mode to which e resolution of the image to be displayed corresponds; and a first control unit 103 configured to, based on the display mode, determine switching units that need to be switched on and switched off, control each switching unit to be switched on or switched off, and control whether each data line outputs an image data.

Optionally, the display mode may be an ultra-high-definition display mode, a full-high-definition display mode, or a high-definition display mode.

Optionally, the second determining unit 102 may be configured to:

in a case where the resolution of the image to be displayed is greater than or equal to a maximum resolution of the display panel, determine that the display mode to which the resolution of the image to be displayed corresponds is the ultra-high-definition display mode;

in a case where the resolution of the image to be displayed is less than the maximum resolution of the display panel and greater than or equal to a half of the maximum resolution of the display panel, determine that the display mode to which the resolution of the image to be displayed corresponds is the full-high-definition display mode;

in a case where the resolution of the image to be displayed is less than a half of the maximum resolution of the display panel and greater than or equal to one third of the maximum resolution of the display panel, determine that the display mode to which the resolution of the image to be displayed corresponds is the high-definition display mode.

Optionally, after determining that the display mode to which the resolution of the image to be displayed corresponds is the ultra-high-definition display mode, the second determining unit 102 may be further configured to:

in a case where a user instruction message is received to change the display mode into the full-high-definition display mode, determine that the display mode to which the resolution of the image to be displayed corresponds is the full-high-definition display mode;

in a case where a user instruction message is received to change the display mode into the high-definition display mode, determine that the display mode to which the resolution of the image to be displayed corresponds is the high-definition display mode.

Optionally, after determining that the display mode to which the resolution of the image to be displayed corresponds is the full-high-definition display mode, the second determining unit 102 may be further configured to:

in a case where a user instruction message is received to change the display mode into the high-definition display mode, determine that the display mode to which the resolution of the image to be displayed corresponds is the high-definition display mode.

Optionally, the first control unit 103 may be configured to:

in a case where the display mode is the ultra-high-definition display mode; control each switching unit to be switched of, and transmit an image signal of the image to be displayed to each data line;

in a case where the display mode is the full-high-definition display mode, control switching units in odd-numbered rows to be switched on and switching units in even-numbered rows to be switched off, and transmit an image signal of the image to be displayed to data lines in odd-numbered rows; or, control switching units in odd-numbered rows to be switched off and control switching units in even-numbered rows to be switched on, and transmit an image signal of the image to be displayed to data lines in even-numbered rows;

in a case where the display mode is the high-definition display mode, control a first switching unit and a second switching unit within each group of switching units to be switched on and control a third switching unit within each group of switching units to be switched off, and transmit an image signal of the image to be displayed to a first data line, a fifth data line, and a ninth data line within each group of data lines, each group of switching units including three adjacent switching units in each column and each group of data lines including every nine adjacent data lines.

Optionally, in a case where the switching units are N-type thin film transistors, a signal controlling the switching units to be switched on is a high level, and a signal controlling the switching units to be switched off is a low level;

in a case where the switching units are P-type thin film transistors, a signal controlling the switching units to be switched on is a low level, and a signal controlling the switching units to be switched off is a high level.

Optionally, the device may further comprise:

a receiving unit configured to receive a voltage signal of an image to be displayed which is transmitted by a signal source;

an image display mode determining unit configured to based on a voltage signal of an image to be displayed of two adjacent frames, and determine current image display mode, wherein the image display mode is a static display mode or a dynamic display mode; and a second control unit configured to, in a case where the image display mode is a static display mode, based on a resolution of the image to be displayed, determine a switching unit that needs to be switched off and control each switching unit to be switched on or off, and output an image signal to a corresponding data line based on an on/off state of the switching unit.

The driving device for the display panel according to the embodiment of the present disclosure can further determine the image display mode of the image to be displayed based on the voltage signal of the image to be displayed. Thus, when it is determined that the image display mode of the image to be displayed is the static display mode, the switching unit that needs to be switched off is determined based on the resolution of the image, a control signal for controlling the switching off of the switching unit is transmitted to the corresponding switching unit, and meanwhile, the image signal is transmitted to the corresponding data signal according to the state of the switching unit, so that when the image display mode of the image to be displayed is the static display mode, through the switching off of the switching unit, the display resolution of the display panel changes from low to high, to increase the resolution of the image to be displayed during static displaying, and improve user experience.

Optionally, the second control unit may be further configured to:

in a case where the image display mode is a dynamic display mode, improve a frame frequency for image transmission.

Optionally, the image display mode determining unit may be configured to:

in a case where the voltage signal of the image to be displayed is the same with a voltage signal of an image displayed in a previous frame, determine the current image display mode as the static display mode;

in a case where the voltage signal of the image to be displayed is different from a voltage signal of an image displayed in a previous frame, determine the current image display mode as the dynamic display mode.

Optionally, the second control unit may be configured to:

in a case where the image display mode is the static display mode, and the resolution of the image to be displayed is less than the maximum resolution of the display panel and greater than or equal to a half of the maximum resolution of the display panel, control each switching unit to be switched off, and transmit an image signal of the image to be displayed to each data line;

in a case where the display mode is the static image display mode, and the resolution of the image to be displayed is less than a half of the maximum resolution of the display panel and greater than or equal to one third of the maximum resolution of the display panel, control each switching unit to be switched off, and transmit an image signal of the image to be displayed to each data line; or, control switching units in odd-numbered rows to be switched on and control switching units in even-numbered rows to be switched off, and transmit an image signal of the image to be displayed to data lines in odd-numbered rows; or, control switching units in odd-numbered rows to be switched off and control switching units in even-numbered rows to be switched on, and transmit an image signal of the image to be displayed to data lines in even-numbered rows.

Figure 11:
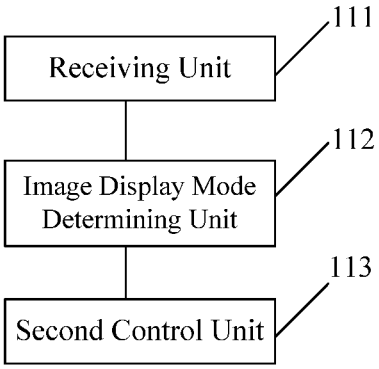
FIG. 11 is a schematic diagram of structure of the driving device for the display panel according to another embodiment of the present disclosure.

FIG. 11 shows a driving device for the display panel according to another embodiment of the present disclosure, the driving device comprises:

a receiving unit 111 configured to receive a voltage signal of an image to be displayed which is transmitted by a signal source;

an image display mode 112 determining unit configured to based on a voltage signal of an image to be displayed of two adjacent frames, determine current image display mode, wherein the image display mode is a static display mode or a dynamic display mode; and a second control unit 113 configured to, in a case where the image display mode is a static display mode, based on a resolution of the image to be displayed, determine a switching unit that needs to be switched off, and output an image signal to a corresponding data line based on an on/off state of the switching unit.

The driving device for the display panel according to the embodiment of the present disclosure determines the image display mode of the image to be displayed based the voltage signal of the image to be displayed. Thus, when it is determined that the image display mode of the image to be displayed is the static display mode, the switching unit that needs to be switched off is determined based on the resolution of the image, a control signal for controlling the switching off of the switching unit is transmitted to the corresponding switching unit, and meanwhile, the image signal is transmitted to the corresponding data signal according to the state of the switching unit; so that when the image display mode of the image to be displayed is the static display mode, through the switching off of the switching unit, the display resolution of the display panel changes from low to high, so as to increase the resolution of the image to be displayed during static displaying and improve user experience.

Optionally, the second control unit 113 may be further configured to:

in a case where the image display mode is a dynamic display mode, improve a frame frequency for image transmission.

Optionally, the image display mode determining unit may be configured to:

in a case where the voltage signal of the image to be displayed is the same with a voltage signal of an image displayed in a previous frame, determine the current image display mode as the static display mode;

in a case where the voltage signal of the image to be displayed is different from a voltage signal of an image displayed in a previous frame, determine the current image display mode as the dynamic display mode.

Optionally, the second control unit 113 may be configured to:

in a case where the image display mode is the static display mode, and the resolution of the image to be displayed is less than the maximum resolution of the display panel and greater than or equal to a half of the maximum resolution of the display panel, control each switching unit to be switched off, and transmit an image signal of the image to be displayed to each data line;

in a case where the display mode is the static image display mode, and the resolution of the image to be displayed is less than a half of the maximum resolution of the display panel and greater than or equal to one third of the maximum resolution of the display panel, control each switching unit to be switched off, and transmit an image signal of the image to be displayed to each data line; or, control switching units in odd-numbered rows to be switched on and control switching units in even-numbered rows to be switched off, and transmit an image signal of the image to be displayed to data lines in odd-numbered rows; or, control switching units in odd-numbered rows to be switched off and control switching units in even-numbered rows to be switched on, and an image signal of the image to be displayed is transmitted to data lines in even-numbered rows.

According to the above, in the display panel according to the embodiment of the present disclosure, at least one switching unit is provided between different gate lines to control whether at least two rows of gate lines are conducted. Each switching unit is connected one by one to second output terminals of the driving control module to receive a control signal outputted by the driving control module for controlling whether to switch on the switching unit; and each data line in the display panel is connected one by one to the second output terminals of the driving control module to receive an image signal outputted by the driving control module. When the switching unit receives the control signal outputted by the driving control module via the first output terminals for controlling the switching unit to be switched on, the switching unit is switched on, so that two rows of gate lines connected to the switching unit perform scanning simultaneously; according to the switching on state of the switching unit, the driving control module outputs the image signal to the data lines to which the two rows of gate lines correspond, so that the display resolution of the display panel is reduced, and the display power consumption of the display panel is decreased. In addition, the driving control module further receives a voltage signal of an image to be displayed which is transmitted by a signal source, and determines an image display mode of the image to be displayed based on the voltage signal. Thus, when the image display mode is determined as a static display mode, based on a resolution of the image to be displayed, the driving control module determines the switching unit that needs to be switched off, and outputs a control signal for controlling a corresponding switching unit to be switched off to the corresponding switching unit, and meanwhile outputs an image signal to a corresponding data line; when the image display mode is determined as a dynamic display mode, the frame frequency is improved for transmitting the image. Thus when the image display mode of the image to be displayed is the static display mode, through switching off the switching unit, the display resolution in the display panel changes from low to high, so that the resolution of the image to be displayed during static displaying is increased and user experience is improved; when it is determined that the image display mode of the image to be displayed is a dynamic display mode, a frame frequency for image transmission is increased, so that fluency when the display panel displays a dynamic image such as video is improved. Thus, the display panel can automatically determining the image display mode of the image to be displayed, automatically decreasing the resolution of the image to be displayed or automatically increasing the resolution of the image to be displayed. And thus, based on the image display mode of the image to be displayed, either resolution of the image in the static display mode is increased, or fluency of the image in the dynamic display mode is improved, so that user experience is improved.

Obviously, those skilled in the art can make various modifications and variations to the present disclosure without departing from the spirit and scope thereof. Thus, if these modifications and variations of the present disclosure are within the scope of the claims of the application as well as their equivalents, the present disclosure is also intended to include these modifications and variations.

The present application claims priority of the Chinese Patent Application No. 201510432508.3 filed on Jul. 21, 2015, the entire disclosure of which is hereby incorporated in full text by reference as part of the present application.

What is claimed is:

1. A display panel, comprising:

a plurality of gate lines, a plurality of data lines, and a plurality of pixels arranged in rows and columns, each of the plurality of gate lines is vertical to each of the plurality of data lines;

a plurality of switching units, each switching unit connected between two adjacent gate lines among the plurality of gate lines, and each switching unit being configured to control whether the two adjacent gate lines are conducted; and a driving control module having a plurality of first output terminals and a plurality of second output terminals, each of the plurality of first output terminals being connected to a control terminal of a corresponding switching unit among the plurality of switching unit, and each of the plurality of second output terminals being connected to an input terminal of a corresponding data line among the plurality of data lines;

wherein the driving control module outputs, via each of the at least one first output terminal, a control signal for controlling whether to switch on the corresponding switching unit, and decides, according to an on/off state of the corresponding switching unit, whether to output an image signal to a corresponding data line via its second output terminal, wherein the driving control module is configured to:

determine, based on a resolution of an image to be displayed which is transmitted by a signal source, a display mode to which the resolution of the image to be displayed corresponds; and determine, based on the display mode, switching units that need to be switched on and switched off, output, via the first output terminals, a control signal for controlling whether to switch on a corresponding switching unit, and output, via the second output terminals, an image signal to a corresponding data line based on an on/off state of the switching unit, wherein, when the display mode to which the resolution of the image to be displayed corresponds is determined as a full-high-definition display mode, either:

switching units in odd-numbered rows of pixels are controlled to be switched on and switching units in even-numbered rows of pixels are controlled to be switched off, and an image signals of the image to be displayed is transmitted to data lines in odd-numbered rows of pixels, or switching units in odd-numbered rows of pixels are controlled to be switched off and switching units in even-numbered rows of pixels are controlled to be switched on, and an image signal of the image to be displayed is transmitted to data lines in even-numbered rows of pixels.

2. The display panel according to claim 1, wherein each switching unit is a thin film transistor, and for each thin film transistor, a source and a drain of the thin film transistor are connected respectively to the two adjacent gate lines, and a gate of the thin film transistor is the control terminal of the switching unit.

3. The display panel according to claim 1, wherein the driving control module is further configured to:

receive voltage signals of an image displayed in a previous frame and a current image to be displayed in a current frame which are transmitted by a signal source;

determine a image display mode based on the received voltage signals; and in a case where the image display mode is a static display mode, determine, based on a resolution of the current image, a switching unit to be switched off among the plurality of switching units, and output via each of the plurality of first output terminals the control signal for controlling the corresponding switching unit that is to be switched on or switched off, and output via the corresponding second output terminal the image signal to the corresponding data line based on an on/off state of the corresponding switching unit.

4. The display panel according to claim 3, wherein the driving control module is further configured to:

in a case where the image display mode is a dynamic display mode, increase a frame frequency of the current frame for transmission of the current image.

5. A driving method for driving the display panel according to claim 1, comprising:

receiving voltage signals of an image displayed in a previous frame and a current image to be displayed in a current frame which are transmitted by the signal source;

determining a image display mode based on the received voltage signals; and in a case where the image display mode is a static display mode, based on a resolution of the current image, determining a switching unit to be switched off among the plurality of switching unit, controlling each of the plurality of switching unit to be switched on or switched off, and outputting the image signal to the corresponding data line based on an on/off state of the corresponding switching unit.

6. The driving method according to claim 5, further comprising:

in a case where the image display mode is a dynamic display mode, increasing a frame frequency for the current frame for transmission of the current image.

7. The driving method according to claim 5, wherein in a case where the voltage signals of the image displayed in the previous frame are the same as those of the current image to be displayed in the current frame, determining the image display mode as the static display mode;

in a case where the voltage signals of the current image to be displayed in the current frame are different from that of the image displayed in the previous frame, determining the image display mode as a dynamic display mode.

8. The driving method according to claim 5, wherein in a case where the image display mode is the static display mode and the resolution of the current image is less than a maximum resolution of the display panel and greater than or equal to a half of the maximum resolution of the display panel, each of the plurality of switching unit is controlled to be switched off, and the image signal of the current image is transmitted to each of the plurality of data lines;

in a case where the image display mode is the static display mode and the resolution of the current image is less than a half of the maximum resolution of the display panel and greater than or equal to one third of the maximum resolution of the display panel, each of the plurality of switching units is controlled to be switched off, and the image signal of the current image is transmitted to each of the plurality of data lines; or, switching units in odd-numbered rows of pixels are controlled to be switched on and switching unit in even-numbered rows of pixels are controlled to be switched off, and the image signal of the current image is transmitted to data lines in the odd-numbered rows of pixels; or, switching units in the odd-numbered rows of pixels are controlled to be switched off and switching units in the even-numbered rows of pixels are controlled to be switched on, and the image signal of the current image is transmitted to data lines in the even-numbered rows of pixels.

9. A driving device for driving the display panel according to claim 1, comprising:

a receiving unit configured to receive voltage signals of an image displayed in a previous frame and a current image to be displayed in a current frame which are transmitted by the signal source;

an image display mode determining unit configured to determine a image display mode based on the received voltage signals; and a control unit configured to, in a case where the image display mode is a static display mode, based on a resolution of the current image, determine a switching unit to be switched off among the plurality of switching units, and output the image signal to the corresponding data line based on an on/off state of the corresponding switching unit.

10. The driving device according to claim 9, wherein the control unit is further configured to:

in a case where the image display mode is a dynamic display mode, increase a frame frequency of the current frame for transmission of the current image.

11. The driving device according to claim 9, wherein the image display mode determining unit is configured to:

in a case where the voltage signals of the image displayed in the previous frame are the same as those of the current image to be displayed in the current frame, determine the image display mode as the static display mode; and in a case where the voltage signals of the current image to be displayed in the current frame are different from those of the image displayed in the previous frame, determine the image display mode as a dynamic display mode.

12. The driving device according to claim 9, wherein the control unit is configured to:

in a case where the image display mode is the static display mode and the resolution of the current image is less than a maximum resolution of the display panel and greater than or equal to a half of the maximum resolution of the display panel, each of the plurality of switching units is controlled to be switched off, and the image signal of the current image is transmitted to each of the plurality of data lines;

in a case where the image display mode is the static display mode and the resolution of the current image is less than a half of the maximum resolution of the display panel and greater than or equal to one third of the maximum resolution of the display panel, each of the plurality of switching units is controlled to be switched off, and the image signal of the current image is transmitted to each of the plurality of data lines; or, switching units in odd-numbered rows of pixels are controlled to be switched on and switching units in even-numbered rows of pixels rows of pixels are controlled to be switched off, and the image signal of the current image is transmitted to data lines in the odd-numbered rows of pixels; or, switching units in the odd-numbered rows of pixels are controlled to be switched off and switching units in the even-numbered rows of pixels are controlled to be switched on, and the image signal of the current image is transmitted to data lines in the even-numbered rows of pixels.

13. A driving method for driving the display panel, the display panel comprises:

a plurality of gate lines, a plurality of data lines, and a plurality of pixels arranged in rows and columns, each of the plurality of gate lines is vertical to each of the plurality of data lines;

a plurality of switching units, each switching unit connected between two adjacent gate lines among the plurality of gate lines, and each switching unit being configured to control whether one or both of the two adjacent gate lines are conducted; and a driving control module having a plurality of first output terminals and a plurality of second output terminals, each of the plurality of first output terminals being connected to a control terminal of a corresponding switching unit among the plurality of switching unit, and each of the plurality of second output terminals being connected to an input terminal of a corresponding data line among the plurality of data lines;

wherein the driving control module outputs, via each of the at least one first output terminal, a control signal for controlling whether to switch on the corresponding switching unit, and decides, according to an on/off state of the corresponding switching unit, whether to output an image signal to a corresponding data line via its second output terminal wherein the driving method comprises:

determining a resolution of an image to be displayed which is transmitted by a signal source;

determining a display mode to which the resolution of the image to be displayed corresponds; and based on the display mode, determining switching units that need to be switched on and switched off, output, via the first output terminals, a control signal for controlling whether to switch on a corresponding switching unit, and output, via the second output terminals, an image signal to a corresponding data line based on an on/off state of the switching unit, wherein, when the display mode to which the resolution of the image to be displayed corresponds is determined as a full-high-definition display mode, either:

switching units in odd-numbered rows of pixels are controlled to be switched on and switching units in even-numbered rows of pixels are controlled to be switched off, and an image signals of the image to be displayed is transmitted to data lines in odd-numbered rows of pixels, or switching units in odd-numbered rows of pixels are controlled to be switched off and switching units in even-numbered rows of pixels are controlled to be switched on, and an image signal of the image to be displayed is transmitted to data lines in even-numbered rows of pixels.

14. The driving method according to claim 13, wherein in a case where the resolution of the image to be displayed is greater than or equal to a maximum resolution of the display panel, the display mode to which the resolution of the image to be displayed corresponds is determined as an ultra-high-definition display mode;

in a case where the resolution of the image to be displayed is less than the maximum resolution of the display panel and greater than or equal to a half of the maximum resolution of the display panel, the display mode to which the resolution of the image to be displayed corresponds is determined as the full-high-definition display mode; and in a case where the resolution of the image to be displayed is less than a half of the maximum resolution of the display panel and greater than or equal to one third of the maximum resolution of the display panel, the display mode to which the resolution of the image to be displayed corresponds is determined as a high-definition display mode.

15. The driving method according to claim 13, further comprising:

receiving a voltage signal of an image to be displayed which is transmitted by a signal source;

determining current image display mode based on the voltage signal of the image to be displayed of two adjacent frames; and in a case where the image display mode is a static display mode, based on a resolution of the image to be displayed, determining a switching unit that needs to be switched off, and controlling each switching unit to be switched on or off, and outputting an image signal to a corresponding data line based on an on/off state of the switching unit.

16. A driving device for driving the display panel, the display panel comprises:

a plurality of gate lines, a plurality of data lines, and a plurality of pixels arranged in rows and columns, each of the plurality of gate lines is vertical to each of the plurality of data lines;

a plurality of switching units, each switching unit connected between two adjacent gate lines among the plurality of gate lines, and each of switching units being configured to control whether one or both of the two adjacent gate lines are conducted; and a driving control module having a plurality of first output terminals and a plurality of second output terminals, each of the plurality of first output terminals being connected to a control terminal of a corresponding switching unit among the plurality of switching unit, and each of the plurality of second output terminals being connected to an input terminal of a corresponding data line among the plurality of data lines;

wherein the driving control module outputs, via each of the at least one first output terminal, a control signal for controlling whether to switch on the corresponding switching unit, and decides, according to an on/off state of the corresponding switching unit, whether to output an image signal to a corresponding data line via its second output terminal, wherein the driving device comprises:

a first determining unit configured to determine a resolution of an image to be displayed which is transmitted by a signal source;

a second determining unit configured to determine a display mode to which the resolution of the image to be displayed corresponds; and a first control unit configured to, based on the display mode, determine switching units that need to be switched on and switched off, output via the first output terminals a control signal for controlling whether to switch on a corresponding switching unit, and output via the second output terminals an image signal to a corresponding data line based on an on/off state of the switching unit, wherein, when the display mode to which the resolution of the image to be displayed corresponds is determined as a full-high-definition display mode, either:

switching units in odd-numbered rows of pixels are controlled to be switched on and switching units in even-numbered rows of pixels are controlled to be switched off, and an image signals of the image to be displayed is transmitted to data lines in odd-numbered rows of pixels, or switching units in odd-numbered rows of pixels are controlled to be switched off and switching units in even-numbered rows of pixels are controlled to be switched on, and an image signal of the image to be displayed is transmitted to data lines in even-numbered rows of pixels.

17. The driving device according to claim 16, wherein the second determining unit is configured to:

in a case where the resolution of the image to be displayed is greater than or equal to a maximum resolution of the display panel, determine that the display mode to which the resolution of the image to be displayed corresponds is an ultra-high-definition display mode;

in a case where the resolution of the image to be displayed is less than the maximum resolution of the display panel and greater than or equal to a half of the maximum resolution of the display panel, determine that the display mode to which the resolution of the image to be displayed corresponds is the full-high-definition display mode; and in a case where the resolution of the image to be displayed is less than a half of the maximum resolution of the display panel and greater than or equal to one third of the maximum resolution of the display panel, determine that the display mode to which the resolution of the image to be displayed corresponds is a high-definition display mode.

18. The driving device according to claim 16, further comprising:

a receiving unit configured to receive a voltage signal of an image to be displayed which is transmitted by the signal source;

an image display mode determining unit configured to determine current image display mode based on a voltage signal of an image to be displayed of two adjacent frames; and a second control unit configured to, in a case where the image display mode is a static display mode, based on a resolution of the image to be displayed, determine a switching unit that needs to be switched off and control each switching unit to be switched on or off, and output an image signal to a corresponding data line based on an on/off state of the switching unit.

* * * * *